US006692095B1

(12) United States Patent
Marumoto et al.

(10) Patent No.: US 6,692,095 B1
(45) **Date of Patent: *Feb. 17, 2004**

(54) COLOR FILTER MANUFACTURING METHOD, COLOR FILTER, DISPLAY DEVICE, AND APPARATUS HAVING DISPLAY DEVICE

(75) Inventors: Yoshitomo Marumoto, Kawasaki (JP); Makoto Akahira, Kawasaki (JP); Hiroshi Fujiike, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/098,337

(22) Filed: Jun. 17, 1998

(30) Foreign Application Priority Data

Jun. 17, 1997 (JP) ..... 9-160194
Jun. 5, 1998 (JP) ..... 10-157974

(51) Int. Cl.[7] ..... B41J 29/38; B41J 3/407
(52) U.S. Cl. ..... 347/14; 347/106
(58) Field of Search ..... 347/14, 17, 19, 347/40, 41, 15

(56) References Cited

U.S. PATENT DOCUMENTS

| | | | | |
|---|---|---|---|---|
| 4,313,124 A | | 1/1982 | Hara | |
| 4,345,262 A | | 8/1982 | Shirato et al. | |
| 4,459,600 A | | 7/1984 | Sato et al. | |
| 4,463,359 A | | 7/1984 | Ayata et al. | |
| 4,558,333 A | | 12/1985 | Sugitani et al. | |
| 4,723,129 A | | 2/1988 | Endo et al. | |
| 4,740,796 A | | 4/1988 | Endo et al. | |
| 4,963,882 A | * | 10/1990 | Hickman | 347/41 |
| 5,124,720 A | * | 6/1992 | Schantz | 347/19 |
| 5,430,469 A | * | 7/1995 | Shioya et al. | 347/15 |
| 5,627,571 A | * | 5/1997 | Anderson et al. | 347/19 |
| 5,847,723 A | | 12/1998 | Akahira et al. | |
| 6,010,205 A | * | 1/2000 | Billet | 347/40 |

FOREIGN PATENT DOCUMENTS

| | | |
|---|---|---|
| EP | 0 761 440 | 3/1997 |
| JP | 59-75205 | 4/1984 |
| JP | 63-235901 | 9/1988 |
| JP | 1-217320 | 8/1989 |
| JP | 7-146406 | 6/1995 |
| JP | 8-292311 | 11/1996 |
| JP | 9-101412 | 4/1997 |

* cited by examiner

*Primary Examiner*—John Barlow
*Assistant Examiner*—Michael S. Brooke
(74) *Attorney, Agent, or Firm*—Fitzpatrick, Cella, Harper & Scinto

(57) ABSTRACT

It is an object of this invention to provide a color filter manufacturing method capable of efficiently using an ink-jet head. To achieve this object, there is provided a color filter manufacturing method of discharging an ink from a plurality of ink discharging nozzles onto a plurality of pixels and forming colored portions while an ink-jet head having the plurality of ink discharging nozzles is relatively scanned with respect to a body to be colored on which the pixels, onto which the ink is to be landed, are aligned in advance, including the steps of, when some of the plurality of ink discharging nozzles for discharging the ink onto the pixels are defective, stopping discharging of the ink from the defective nozzles, and compensating for a lack of an ink amount in the Nth pixel owing to an omission of the defective nozzles, by other nozzles for discharging the ink onto the pixels.

15 Claims, 23 Drawing Sheets

COLOR FILTER MANUFACTURING METHOD, COLOR FILTER, DISPLAY DEVICE, AND APPARATUS HAVING DISPLAY DEVICE

BACKGROUND OF THE INVENTION

1. Field of the Invention

The present invention relates to a color filter manufacturing method of manufacturing a color filter by discharging inks onto a body to be colored using ink-jet heads having a plurality of ink discharging nozzles and forming colored portions, a color filter, a display device, and an apparatus having the display device.

2. Description of the Related Art

With recent advances in personal computers, especially portable personal computers, demands tend to arise for liquid crystal displays, especially color liquid crystal displays. However, in order to further popularize the use of liquid crystal displays, a reduction in cost must be achieved. Especially, it is required to reduce the cost of a color filter which occupies a large proportion of the total cost. Various methods have been tried to satisfy the required characteristics of color filters while meeting the above requirements. However, any method capable of satisfying all the requirements has not been established. The respective methods will be described below. The first method is a pigment dispersion method. In this method, a pigment-dispersed photosensitive resin layer is formed on a substrate and patterned into a single-color pattern. This process is repeated three times to obtain R, G, and B color filter layers.

The second method is a dyeing method. In the dyeing method, a glass substrate is coated with a water-soluble polymer material as a dyeable material, and the coating is patterned into a desired shape by a photolithography process. The obtained pattern is dipped in a dye bath to obtain a colored pattern. This process is repeated three times to form R, G, and B color filter layers.

The third method is an electrodeposition method. In this method, a transparent electrode is patterned on a substrate, and the resultant structure is dipped in an electrodeposition coating fluid containing a pigment, a resin, an electrolyte, and the like to be colored in the first color by electrodeposition. This process is repeated three times to form R, G, and B color filter layers. Finally, these layers are calcined.

The fourth method is a print method. In this method, a pigment is dispersed in a thermosetting resin, and a print operation is repeated three times to form R, G, and B coatings separately. Colored layers are then formed by thermosetting the resins. In either of the above methods, a protective layer is generally formed on the colored layers.

The point common to these methods is that the same process must be repeated three times to obtain layers colored in three colors, i.e., R, G, and B. This causes an increase in cost. In addition, as the number of processes increases, the yield decreases. In the electrodeposition method, limitations are imposed on pattern shapes which can be formed. For this reason, with the existing techniques, this method is difficult to be applied to TFTs. In the print method, a pattern with a fine pitch is difficult to be formed because of poor resolution and poor evenness.

In order to eliminate these drawbacks, methods of manufacturing color filters by an ink-jet system are disclosed in Japanese Patent Laid-Open Nos. 59-75205, 63-235901, and 1-217320. In these methods, three color inks containing coloring materials of three colors, i.e., R, G, and B, are discharged on a transparent substrate by an ink-jet system, and the respective inks are dried to form colored pixel portions. In such an ink-jet system, R, G, and B pixels can be formed at once, allowing great simplification of the manufacturing process and a great reduction in cost.

In the manufacturing method with the conventional ink-jet system, however, a slight difference between the discharge states of the respective nozzles of the ink-jet head directly influences color filter defects. Conceivable discharge state parameters directly related to color filter defects include the ink landing position, the ink discharging amount, the dot diameter, and the presence/absence of satellite discharging.

For example, the ink discharging amount and the dot diameter are important parameters which influence defects such as a color mixing defect between adjacent pixels and a color irregularity defect caused by a nonuniform amount of ink landed onto each pixel. As for a nozzle having an excessively large or small ink discharging amount or an excessively large or small dot diameter, the discharge state of the nozzle is often different from a designed state for the ink-jet head. Repeating unstable discharging decreases the yield.

The presence of satellite discharging also leads to defects such as a color mixing defect of coloring another pixel, thereby decreasing the yield.

The landing position shift causes a color mixing defect between pixels of a color filter and an excessively bright defect after an ink shifts from pixels. This directly influences the yield.

In the ink-jet method, a large-area color filter can be formed within a short time by using many nozzles for coloring pixels at once. FIG. 20 is a schematic view of an ink-jet head used to color a color filter. In coloring a color filter with many nozzles, nozzles used for coloring are determined by a pixel pattern. The nozzles used are set to make it possible to accurately color pixels aligned at constant pitches while a color filter substrate and the ink-jet head are relatively changed in angle and relatively scanned (FIG. 21). To color a large-area substrate at once, the angles of the color filter substrate and the ink-jet head are preferably small in a direction perpendicular to nozzle alignment and a substrate scanning direction when these angles change (FIGS. 23A and 23B).

In FIG. 21, every third nozzle is used for coloring. As shown in FIG. 22, a different combination (nozzle set) of nozzles can be used by shifting nozzles in use to adjacent ones. The nozzles of the ink-jet head are wasted after long-time use. Therefore, if all three types of nozzle sets can be used, all the head nozzles can be used until they are wasted (normal operation service life).

However, when a given discharging nozzle is defective and cannot color a color filter, a nozzle set including the defective nozzle cannot be used. For this reason, all the head nozzles cannot be used for the full normal operation service life. In other words, the use period of the head is shortened. The ink-jet head must be frequently exchanged, thereby resulting in high cost.

SUMMARY OF THE INVENTION

The present invention has been made in consideration of the above situation, and has as its object to provide a color filter manufacturing method capable of efficiently using an ink-jet head.

It is another object of the present invention to provide a color filter manufactured by the manufacturing method, a display device, and an apparatus having the display device.

To solve the above problems and achieve the above objects, a color filter manufacturing method according to the present invention is characterized by the following steps.

There is provided a color filter manufacturing method of discharging an ink from a plurality of ink discharging nozzles onto a plurality of pixels and forming colored portions while an ink-jet head having the plurality of ink discharging nozzles is relatively scanned with respect to a body to be colored on which the pixels, onto which the ink is to be landed, are aligned in advance, comprising the steps of, when some of the plurality of ink discharging nozzles for discharging the ink onto the pixels are defective, stopping discharging of the ink from the defective nozzles, and compensating for a lack of an ink amount in pixels owing to an omission of the defective nozzles, by other nozzles for discharging the ink onto the pixels.

A color filter according to the present invention is characterized by the following arrangement.

There is provided a color filter manufactured by discharging an ink from a plurality of ink discharging nozzles onto a plurality of pixels and forming colored portions while an ink-jet head having the plurality of ink discharging nozzles is relatively scanned with respect to a body to be colored on which the pixels, onto which the ink is to be landed, are aligned in advance, the color filter being manufactured through the step of, when some of the plurality of ink discharging nozzles for discharging the ink onto the pixels are defective, stopping discharging of the ink from the defective nozzles, and the step of compensating for a lack of an ink amount in pixels owing to an omission of the defective nozzles, by other nozzles for discharging the ink onto the pixels.

A display device according to the present invention is characterized by the following arrangement.

There is provided a display device having a color filter manufactured by discharging an ink from a plurality of ink discharging nozzles onto a plurality of pixels and forming colored portions while an ink-jet head having the plurality of ink discharging nozzles is relatively scanned with respect to a body to be colored on which the pixels, onto which the ink is to be landed, are aligned in advance, integrally comprising a color filter being manufactured through the step of, when some of the plurality of ink discharging nozzles for discharging the ink onto the pixels are defective, stopping discharging of the ink from the defective nozzles, and the step of compensating for a lack of an ink amount in pixels owing to an omission of the defective nozzles, by other nozzles for discharging the ink onto the pixels, and light amount changing means for changing a light amount.

An apparatus having a display device according to the present invention is characterized by the following arrangement.

There is provided an apparatus having a display device with a color filter manufactured by discharging an ink from a plurality of ink discharging nozzles onto a plurality of pixels and forming colored portions while an ink-jet head having the plurality of ink discharging nozzles is relatively scanned with respect to a body to be colored on which the pixels, onto which the ink is to be landed, are aligned in advance, comprising: a display device integrally comprising a color filter being manufactured through the step of, when some of the plurality of ink discharging nozzles for discharging the ink onto the pixels are defective, stopping discharging of the ink from the defective nozzles, and the step of compensating for a lack of an ink amount in pixels owing to an omission of the defective nozzles, by other nozzles for discharging the ink onto the pixels, and light amount changing means for changing a light amount; and image signal supply means for supplying an image signal to the display device.

Other objects and advantages besides those discussed above shall be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENTS

The preferred embodiments of the present invention will be described in detail below with reference to the accompanying drawings.

Note that a color filter defined in the present invention comprises a colored portion and a body to be colored, and can convert input light into output light having changed characteristics.

Figure 1:
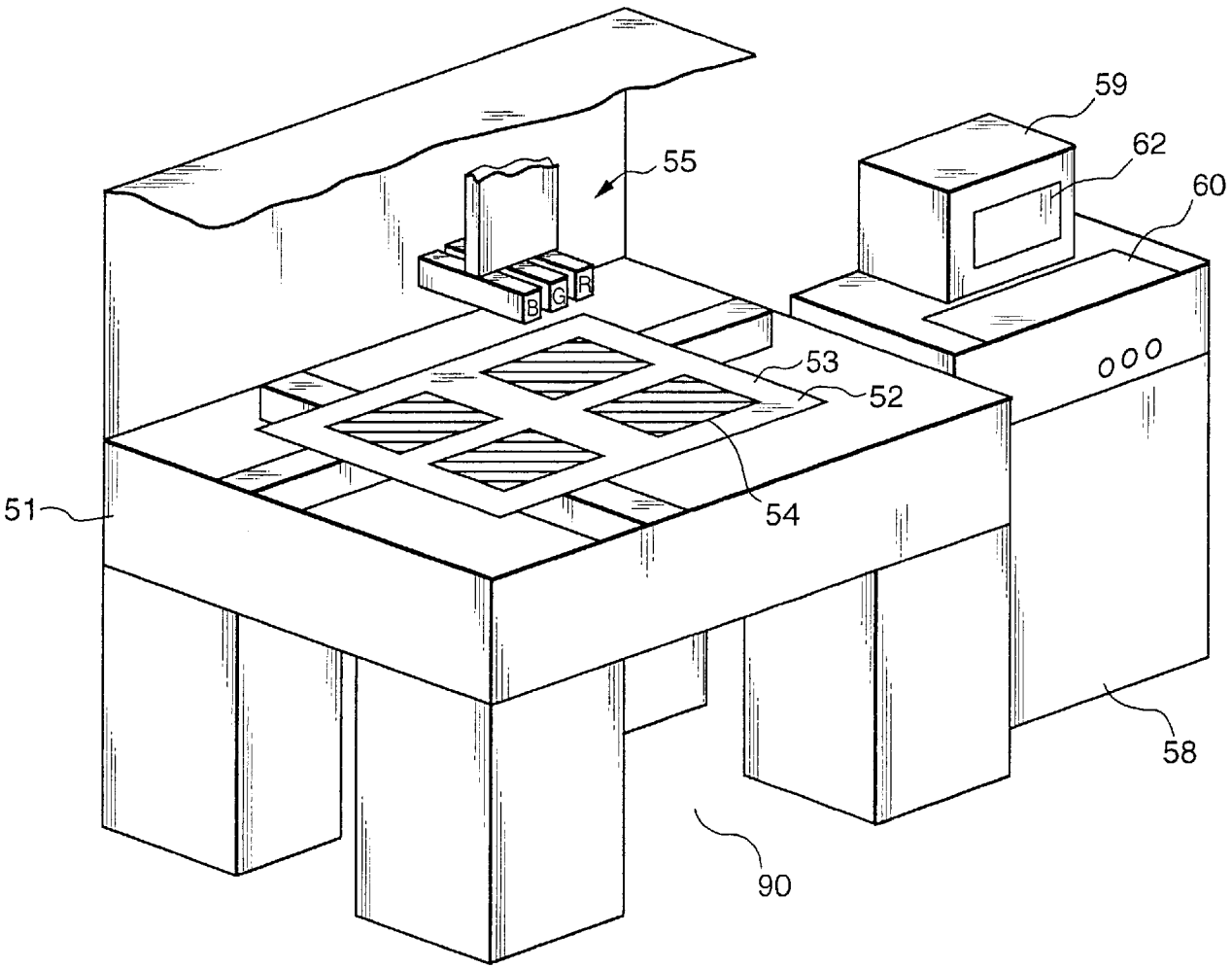
FIG. 1 is a schematic perspective view showing the arrangement of a color filter manufacturing apparatus according to an embodiment of the present invention.

FIG. 1 is perspective view showing the arrangement of a color filter manufacturing apparatus according to an embodiment of the present invention.

Referring to FIG. 1, reference numeral 51 denotes an apparatus base; 52, an X-Y-θ stage disposed on the apparatus base 51; 53, a color filter substrate set on the X-Y-θ stage 52; 54, color filters formed on the color filter substrate 53; 55, R (red), G (green), and B (blue) ink-jet heads for coloring the color filters 54; 58, a controller for controlling the overall operation of a color filter manufacturing apparatus 90; 59, a teaching pendant (personal computer) as the display unit of the controller; and 60, a keyboard as the operation unit of the teaching pendant 59.

Figure 2:
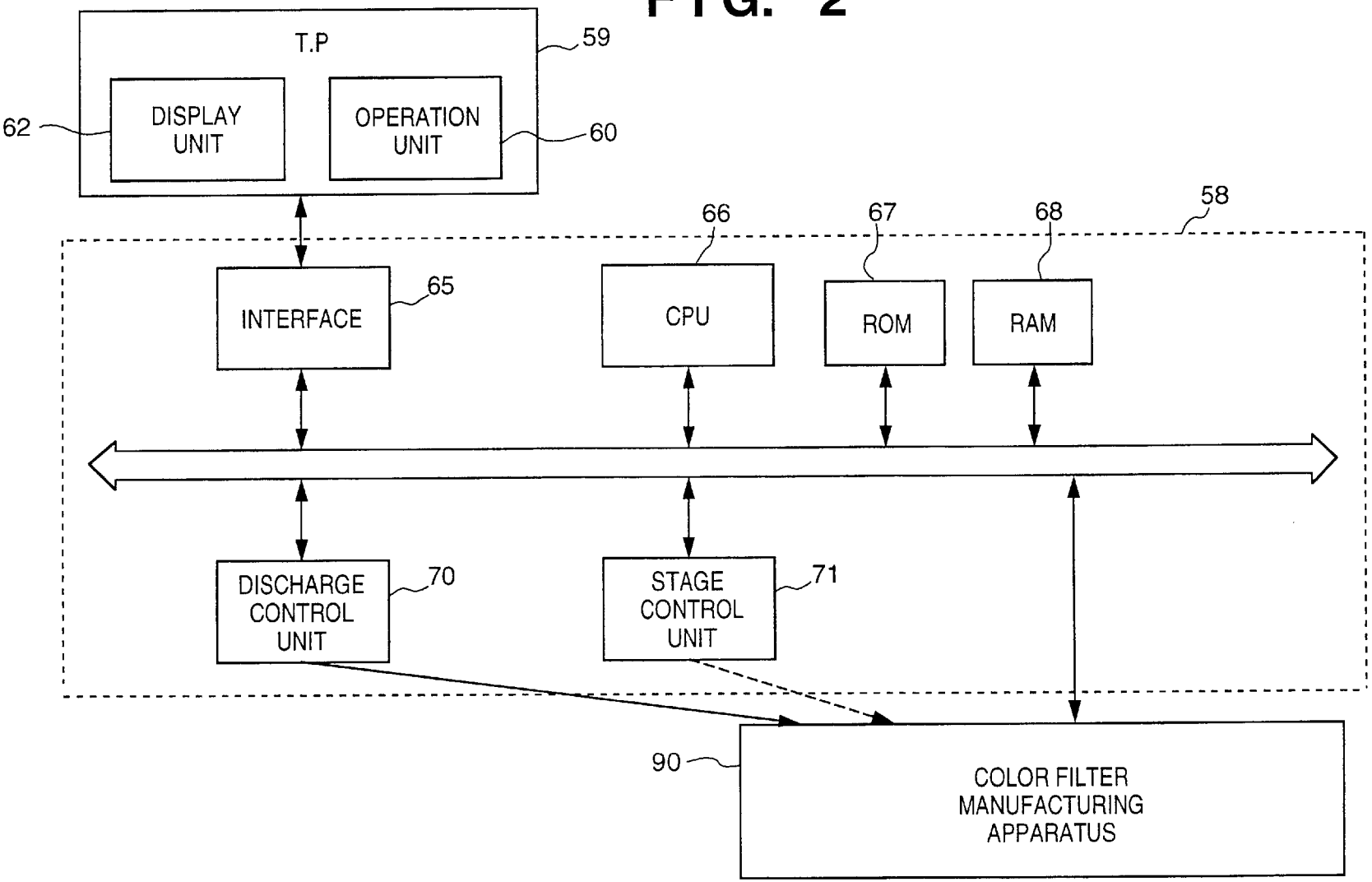
FIG. 2 is a block diagram showing the arrangement of a control unit for controlling the operation of the color filter manufacturing apparatus.

FIG. 2 is a block diagram showing the arrangement of the controller of the color filter manufacturing apparatus 90. The teaching pendant 59 serves as the input/output means of the controller 58. Reference numeral 62 denotes a display unit for displaying how a manufacturing process progresses, information indicating the presence/absence of a head abnormality, and the like. The operating unit (keyboard) 60 designates an operation of the color filter manufacturing apparatus 90 and the like.

The controller 58 controls the overall operation of the color filter manufacturing apparatus 90. Reference numeral 65 denotes an interface for exchanging data with the teaching pendant 59; 66, a CPU for controlling the color filter manufacturing apparatus 90; 67, a ROM storing control programs for operating the CPU 66; 68, a RAM for storing abnormality information and the like; 70, a discharge control unit for controlling discharging of an ink into each pixel of a color filter; and 71, a stage control unit for controlling the operation of the X-Y-θ stage 52 of the color filter manufacturing apparatus 90. The color filter manufacturing apparatus 90 is connected to the controller 58 and operates in accordance with instructions therefrom.

Figure 3:
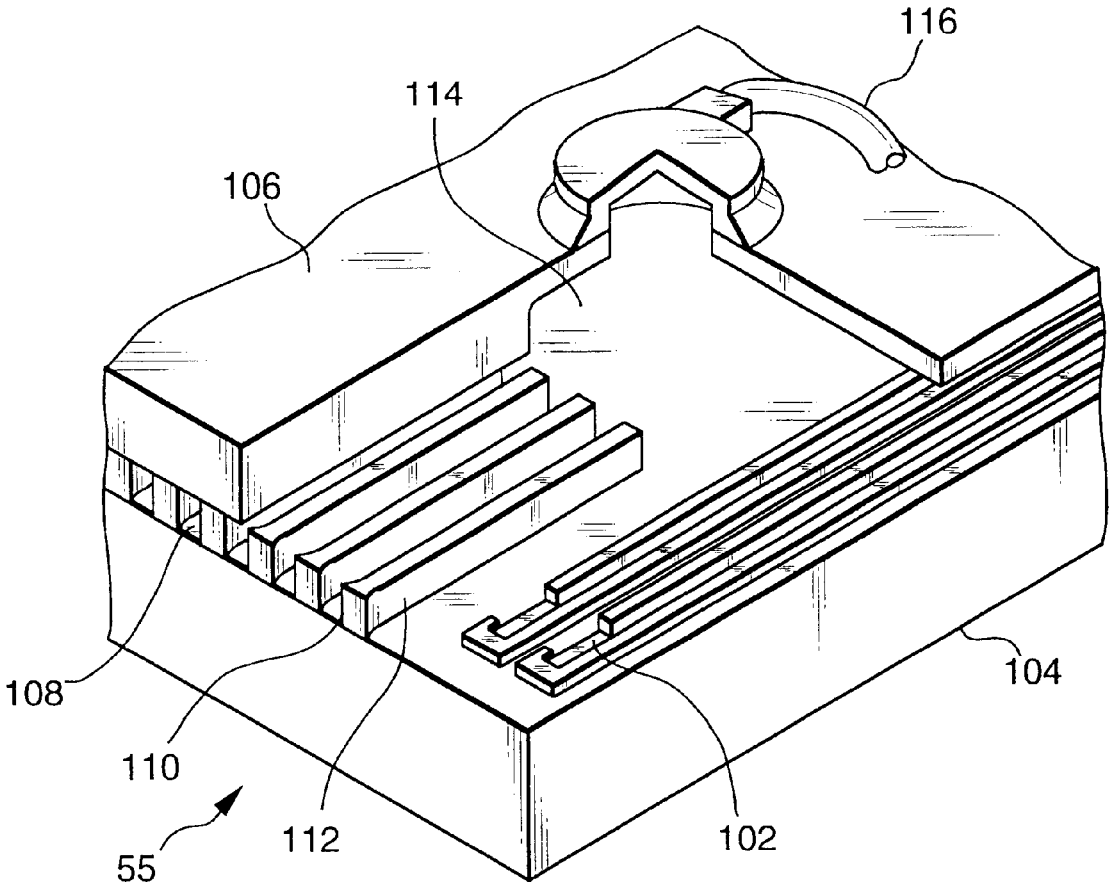
FIG. 3 is a perspective view showing the structure of an ink-jet head used in the color filter manufacturing apparatus.

FIG. 3 is a perspective view showing the structure of the ink-jet head 55 used in the color filter manufacturing apparatus 90. Referring to FIG. 1, three ink-jet heads are arranged in correspondence with three colors, i.e., R, G, and B. Since these three heads have the same structure, FIG. 3 shows the structure of one of the three heads as a representative.

Referring to FIG. 3, the ink-jet head 55 mainly comprises a heater board 104 as a board on which a plurality of heaters 102 for heating an ink are formed, and a ceiling plate 106 mounted on the heater board 104. A plurality of discharging openings 108 are formed in the ceiling plate 106. Tunnel-like fluid passages 110 communicating with the discharging openings 108 are formed therebehind. The respective fluid passages 110 are isolated from the adjacent fluid passages via partition walls 112. The respective fluid passages 110 are commonly connected to one ink chamber 114 at the rear side of the fluid passages. An ink is supplied to the ink chamber 114 via an ink inlet 116. This ink is supplied from the ink chamber 114 to each fluid passage 110.

The heater board 104 and the ceiling plate 106 are positioned such that the position of each heater 102 coincides with that of a corresponding fluid passage 110, and are assembled into the state shown in FIG. 3. Although FIG. 3 shows only two heaters 102, one heater 102 is arranged in correspondence with each fluid passage 110. When a predetermined driving signal is supplied to the heater 102 in the assembled state shown in FIG. 3, an ink above the heater 102 is boiled to produce a bubble, and the ink is pushed and discharged from the discharging opening 108 upon volume expansion of the ink. Therefore, the size of a bubble can be adjusted by controlling a driving pulse applied to the heater 102, e.g., controlling the magnitude of power. That is, the volume of the ink discharged from each discharging opening can be arbitrarily controlled.

FIGS. 4A to 4F show the process of manufacturing a color filter.

The substrate of the color filter of the present invention is preferably a transparent substrate and generally made of a glass substrate. However, a substrate other than a glass substrate can be used as long as it has characteristics required for a liquid crystal color filter, e.g., good transparency and high mechanical strength.

Figure 4A:
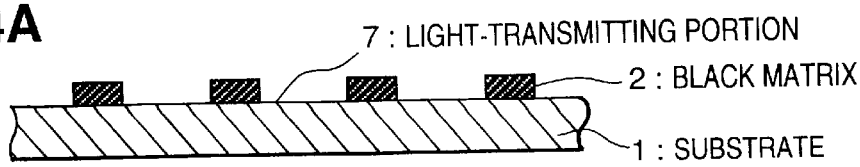
FIGS. 4A to 4F are sectional views showing a color filter manufacturing process.
Figure 4B:
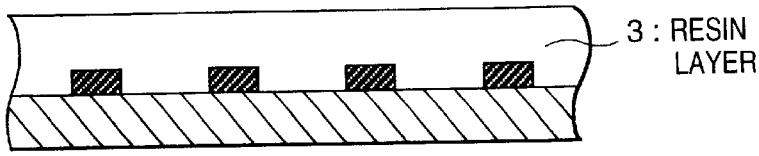

FIG. 4A shows a glass substrate 1 having light-transmitting portions 7 and a black matrix 2 serving as light-shielding portions. First of all, the glass substrate 1, on which the black matrix 2 is formed, is coated with a resin composition which can be cured upon irradiation of light or irradiation of light and heating, and has ink receptivity. The resultant structure is pre-baked, as needed, to form a resin layer 3 (FIG. 4B). The resin layer 3 can be formed by a coating method such as spin coating, roller coating, bar coating, spraying, or dipping. However, the present invention is not limited to any specific coating method.

Figure 4C:
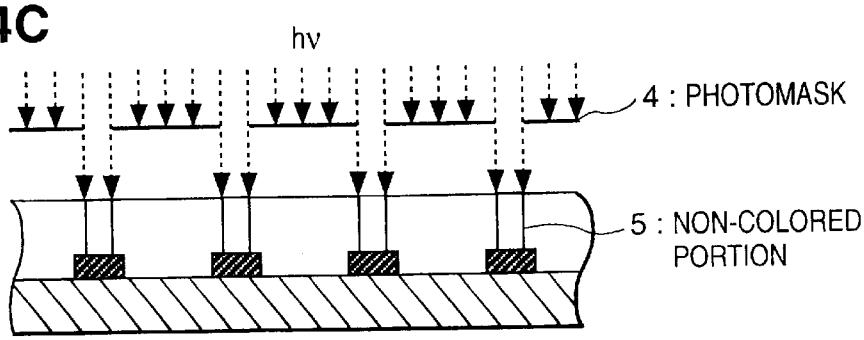
Figure 4D:
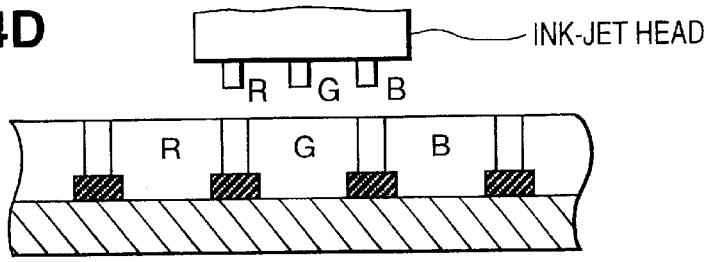

Subsequently, pattern exposure is performed in advance onto resin layer portions light-shielded by the black matrix 2 by using a photomask 4 to cure the exposed portions of the resin layer so as to form portions 5 (non-colored portions) which do not absorb an ink. As a result, a body to be colored with a plurality of pixels (cells) aligned in advance onto which an ink is to be landed is formed (FIG. 4C). Thereafter, the resin layer is colored in R, G, and B at once by using the ink-jet heads (FIG. 4D), and the inks are dried, as needed.

As the photomask 4 used when pattern exposure is performed, a mask having opening portions for curing the portions light-shielded by the black matrix is used. In this case, in order to prevent a color omission of the color material at a portion in contact with the black matrix, a relatively large amount of ink must be discharged. For this reason, a mask having opening portions each having a size smaller than the width of each light-shielding portion of the black matrix is preferably used.

As an ink to be used for a coloring operation, both dye and pigment inks can be used, and both liquid and solid inks can be used.

As a curable resin composition to be used in the present invention, any resin composition which has ink receptivity and can be cured by at least one of the following treatments: irradiation of light and a combination of irradiation of light and heating, can be used. As resins, acrylic resin, epoxy resin, and silicone resin are available. As cellulose derivatives, hydroxypropyl cellulose, hydroxy ethyl cellulose, methyl cellulose, carboxymethyl cellulose are available, and modified materials thereof are also available.

Optical initiators (crosslinkers) can also be used to crosslink these resins by irradiation of light or irradiation of light and heating. As optical initiators, dichromate, a bis-azide compound, a radical-based initiator, a cation-based initiator, an anion-based initiator, and the like can be used. Mixtures of these optical initiators and combinations of the initiators and sensitizers can also be used. In addition, an optical acid generating agent such as onium salt can be used as a crosslinker. In order to make a crosslinking reaction further progress, a heat treatment may be performed after irradiation of light.

Resin layers containing these compositions have excellent heat resistance, excellent water resistance, and the like, and are sufficiently resistant to high temperatures and cleaning in the subsequent steps.

As an ink-jet system used in the present invention, a bubble-jet type using an electrothermal converter as an energy generating element, a piezoelectric jet type using a piezoelectric element, or the like can be used. A coloring area and coloring pattern can be arbitrarily set.

This embodiment exemplifies the structure in which the black matrix is formed on the substrate. However, after a curable resin composition layer is formed or after coloring is performed, a black matrix may be formed on the resin layer without posing any problem. That is, the form of a black matrix is not limited to that in this embodiment. As a method of forming a black matrix, a method of forming a thin metal film on a substrate by sputtering or deposition, and patterning the film by a photolithographic process is preferably used. However, the present invention is not limited to this.

Figure 4E:
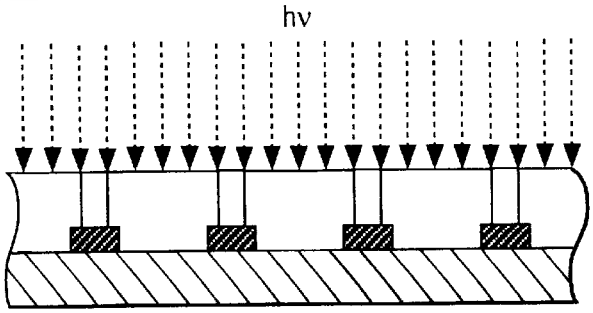
Figure 4F:
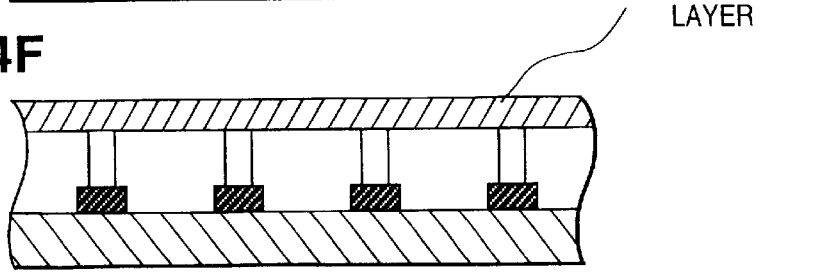

Subsequently, the curable resin composition is cured by performing only one of the following treatments: irradiation of light, a heat treatment, and a combination of irradiation of light and a heat treatment (FIG. 4E). A protective layer 8 is formed, as needed (FIG. 4F). Note that reference symbol hv denotes the intensity of light. When a heat treatment is to be performed, heat is applied instead of hv. The protective layer 8 can be made of a second resin composition of a photo-setting type, thermosetting type, or photo-setting/thermosetting type. The resultant layer needs to have transparency upon formation of a color filter and be sufficiently resistant to the subsequent processes such as an ITO formation process and an aligning film formation process.

Figure 5:
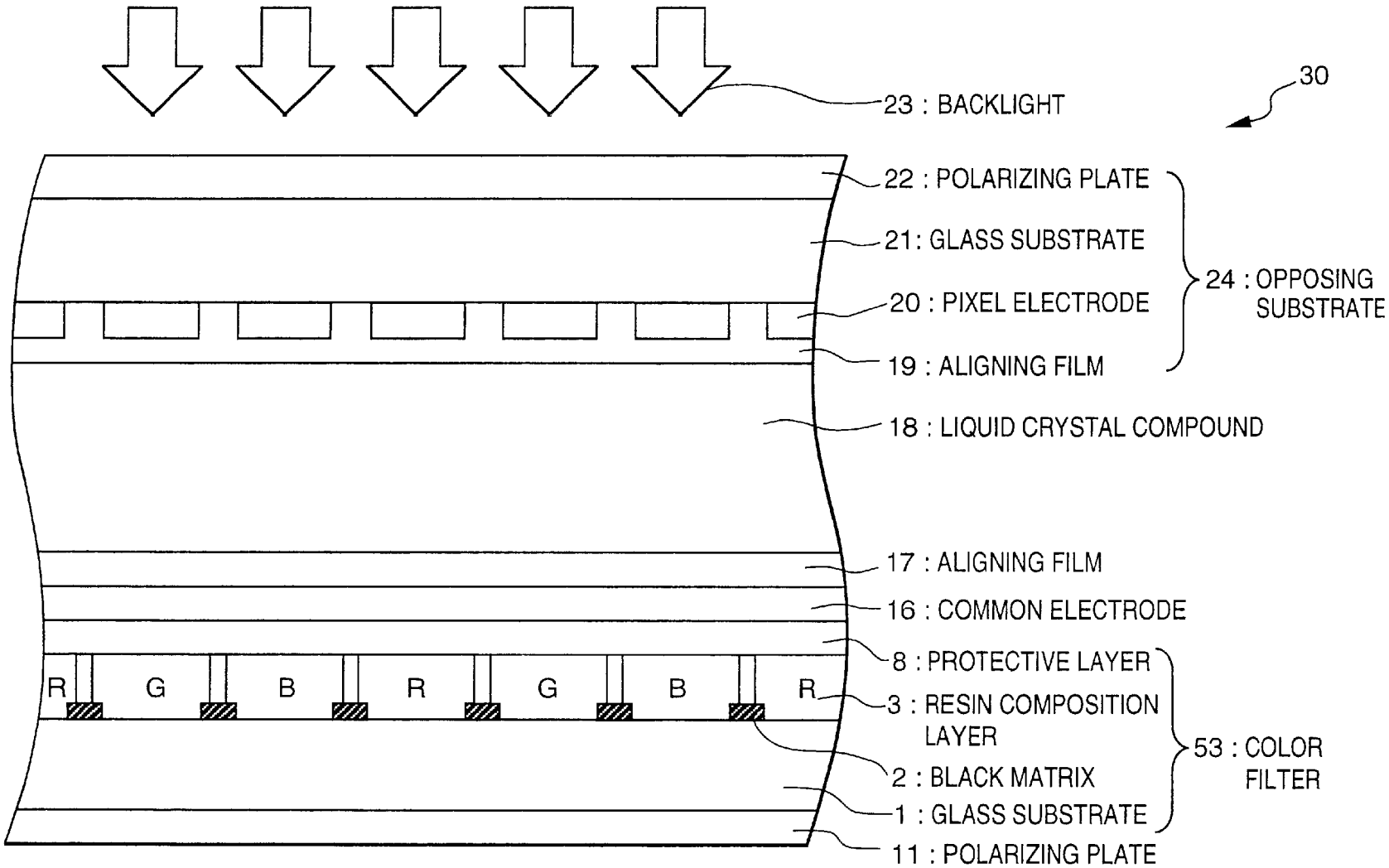
FIG. 5 is a sectional view showing an example of the basic structure of a color liquid crystal display device incorporating a color filter according to the embodiment.
Figure 6:
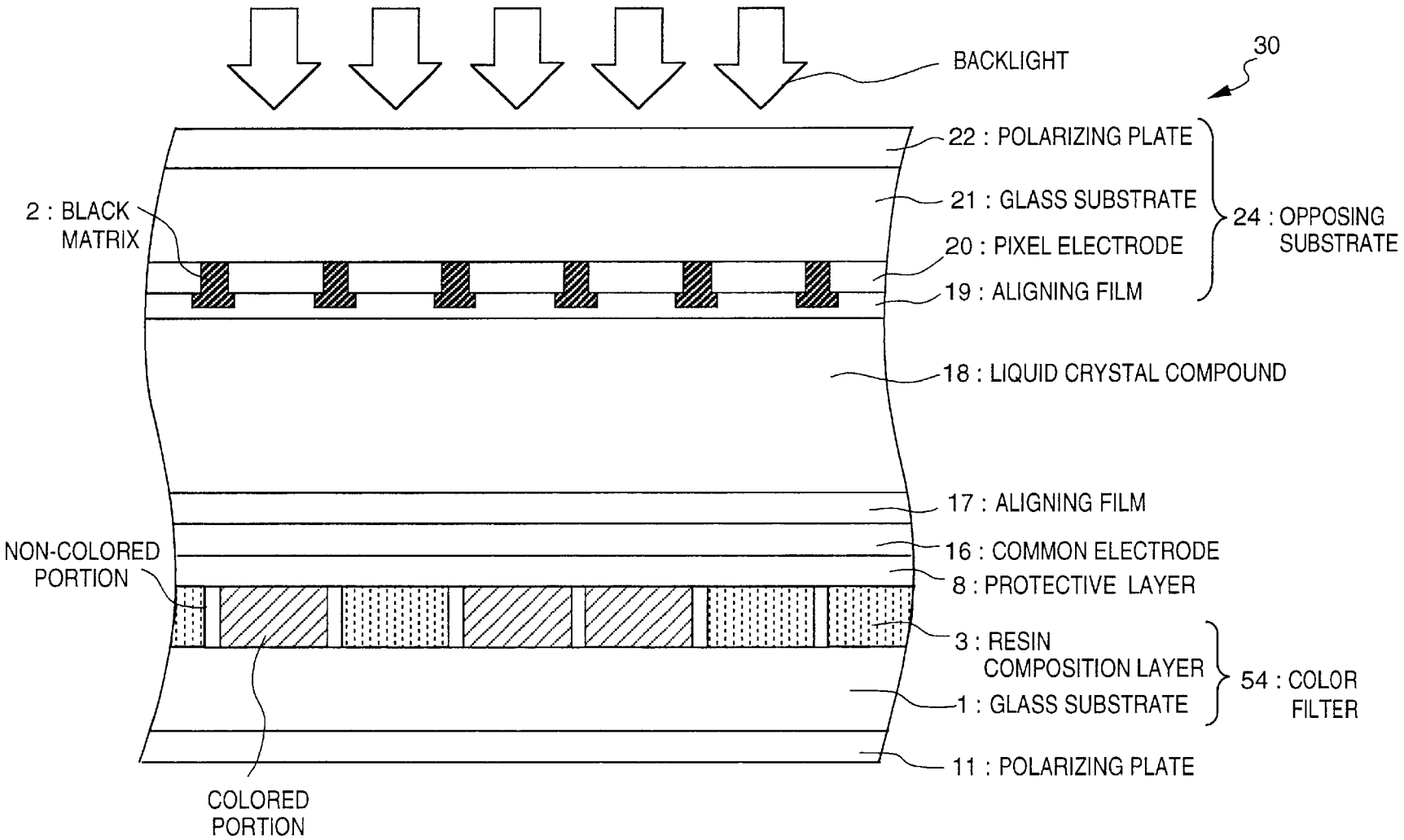
FIG. 6 is a sectional view showing another example of the basic structure of the color liquid crystal display device incorporating the color filter according to the embodiment.
Figure 7:
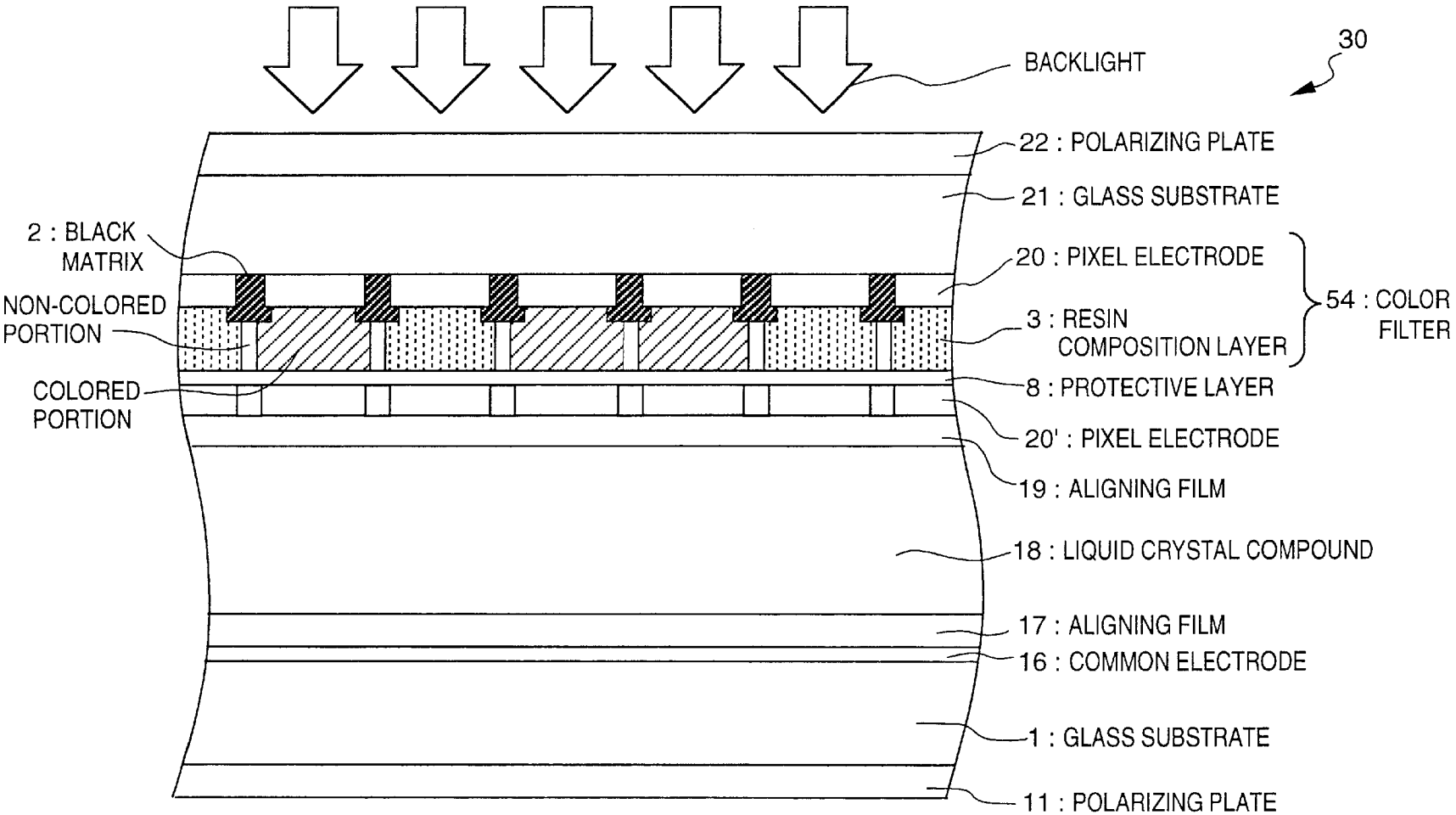
FIG. 7 is a sectional view showing still another example of the basic structure of the color liquid crystal display device incorporating the color filter according to the embodiment.

FIGS. 5 to 7 are sectional views showing the basic structure of a color liquid crystal display device 30 incorporating the above color filter.

In general, a color liquid crystal display device is formed by joining the color filter 53 to a counter substrate 24 and sealing a liquid crystal compound 18 therebetween. TFTs (Thin Film Transistors) (not shown) and transparent pixel electrodes 20 are formed on the inner surface of one substrate 21 of the liquid crystal display device in a matrix form. The color filter 53 is placed on the inner surface of the glass substrate 1 such that the R, G, and B coloring materials are positioned to oppose the pixel electrodes. A transparent counter electrode (common electrode) 16 is formed on the entire surface of the color filter 53. The black matrix 2 is generally formed on the color filter 53 side (see FIG. 5). However, in a BM (Black Matrix) on-array type liquid crystal panel, the black matrix 2 is formed on a counter substrate side. Aligning films 19 are formed within the planes of the two substrates. By performing a rubbing process for the aligning films, the liquid crystal molecules can be aligned in a predetermined direction. Polarizing plates 11 and 22 are bonded to the outer surface of the respective glass substrates. The liquid crystal compound 18 is filled in the gap (about 2 to 5 $\mu$m) between these glass substrates. As a backlight, a combination of a fluorescent lamp (not shown) and a scattering plate (not shown) is generally used. A display operation is performed by causing the liquid crystal compound to serve as an optical shutter for changing the transmittance of light emitted from the backlight.

As shown in FIG. 7, a colored portion may be formed on the pixel electrodes 20 and made to function as a color filter. That is, the colored portion constituting a color filter is not necessarily formed on a glass substrate. In FIG. 7, an ink receptible layer is formed on pixel electrodes and coated with an ink. Alternatively, a resin ink containing a coloring material is directly landed on pixel electrodes.

A case wherein the above liquid crystal display device is applied to an information processing apparatus will be described below with reference to FIGS. 8 to 10.

Figure 8:
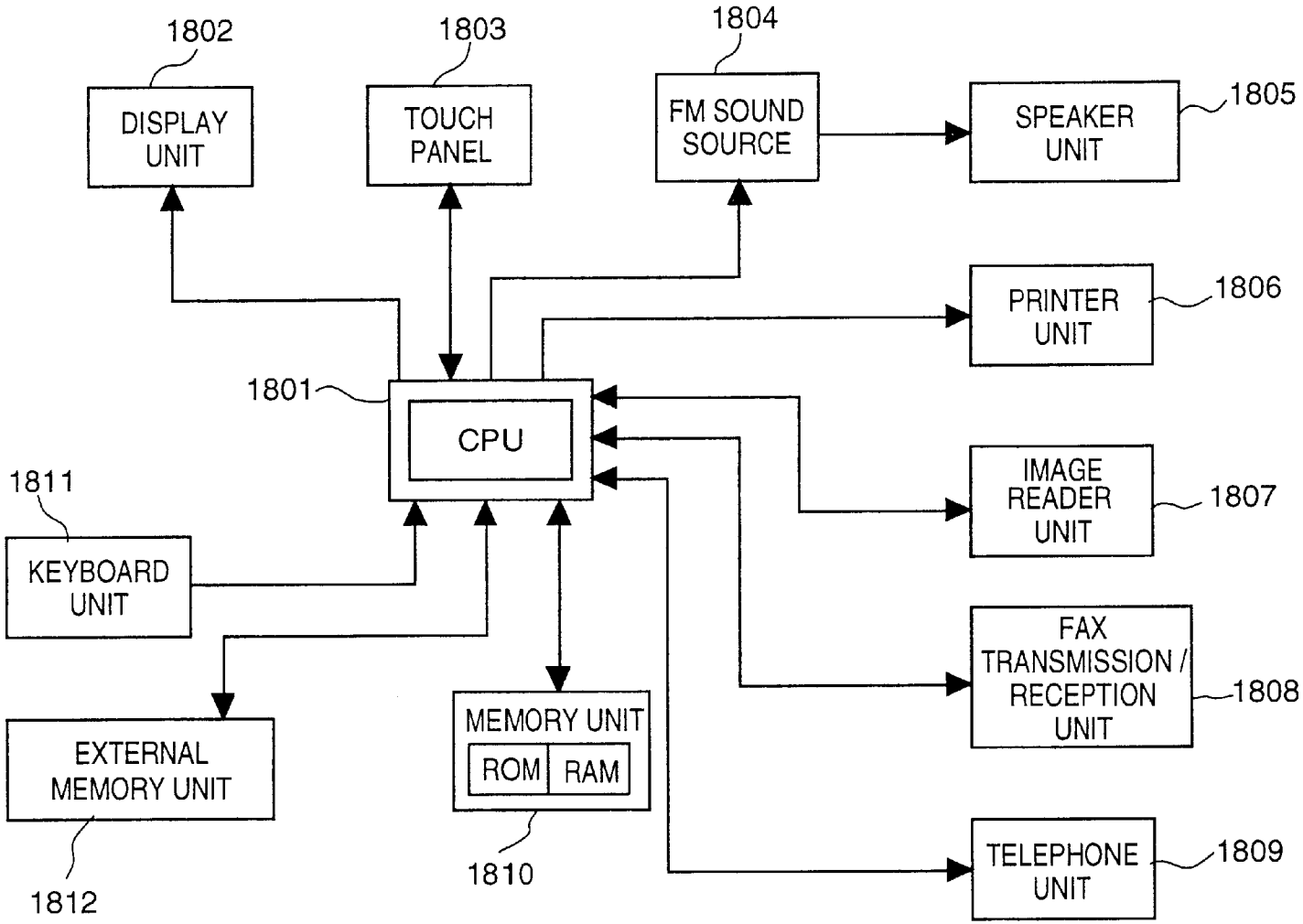
FIG. 8 is a block diagram showing an information processing apparatus in which the liquid crystal display device is used.

FIG. 8 is a block diagram showing the schematic arrangement of an information processing apparatus serving as a wordprocessor, a personal computer, a facsimile apparatus, and a copying machine, to which the above liquid crystal display device is applied.

Referring to FIG. 8, reference numeral 1801 denotes a control unit for controlling the overall apparatus. The control unit 1801 includes a CPU such as a microprocessor and various I/O ports, and performs control by outputting/inputting control signals, data signals, and the like to/from the respective units. Reference numeral 1802 denotes a display unit for displaying various menus, document information, and image data read by an image reader 1807, and the like on the display screen; 1803, a transparent, pressure-sensitive touch panel mounted on the display unit 1802. By pressing the surface of the touch panel 1803 with a finger of the user or the like, an item input operation, a coordinate position input operation, or the like can be performed on the display unit 1802.

Reference numeral 1804 denotes an FM (Frequency Modulation) sound source unit for storing music information, created by a music editor or the like, in a memory unit 1810 or an external memory unit 1812 as digital data, and reading out the information from such a memory, thereby performing FM modulation of the information. An electrical signal from the FM sound source unit 1804 is converted into an audible sound by a speaker unit 1805. A printer unit 1806 is used as an output terminal for the wordprocessor, the personal computer, the facsimile apparatus, and the copying machine.

Reference numeral 1807 denotes an image reader unit for photoelectrically reading original data. The image reader unit 1807 is arranged midway along the original convey passage and designed to read originals for facsimile and copy operations and other various originals.

Reference numeral 1808 denotes a transmission/reception unit for the facsimile (FAX) apparatus. The transmission/reception unit 1808 transmits original data read by the image reader unit 1807 by facsimile, and receives and decodes a sent facsimile signal. The transmission/reception unit 1808 has an interface function for external units. Reference numeral 1809 denotes a telephone unit having a general telephone function and various telephone functions such as an answering function.

Reference numeral 1810 denotes a memory unit including a ROM for storing system programs, manager programs, application programs, fonts, and dictionaries, a RAM for storing an application program loaded from the external memory unit 1812 and document information, a video RAM, and the like.

Reference numeral 1811 denotes a keyboard unit for inputting document information and various commands.

Reference numeral 1812 denotes an external memory unit using a floppy disk, a hard disk, and the like. The external memory unit 1812 serves to store document information, music and speech information, application programs of the user, and the like.

Figure 9:
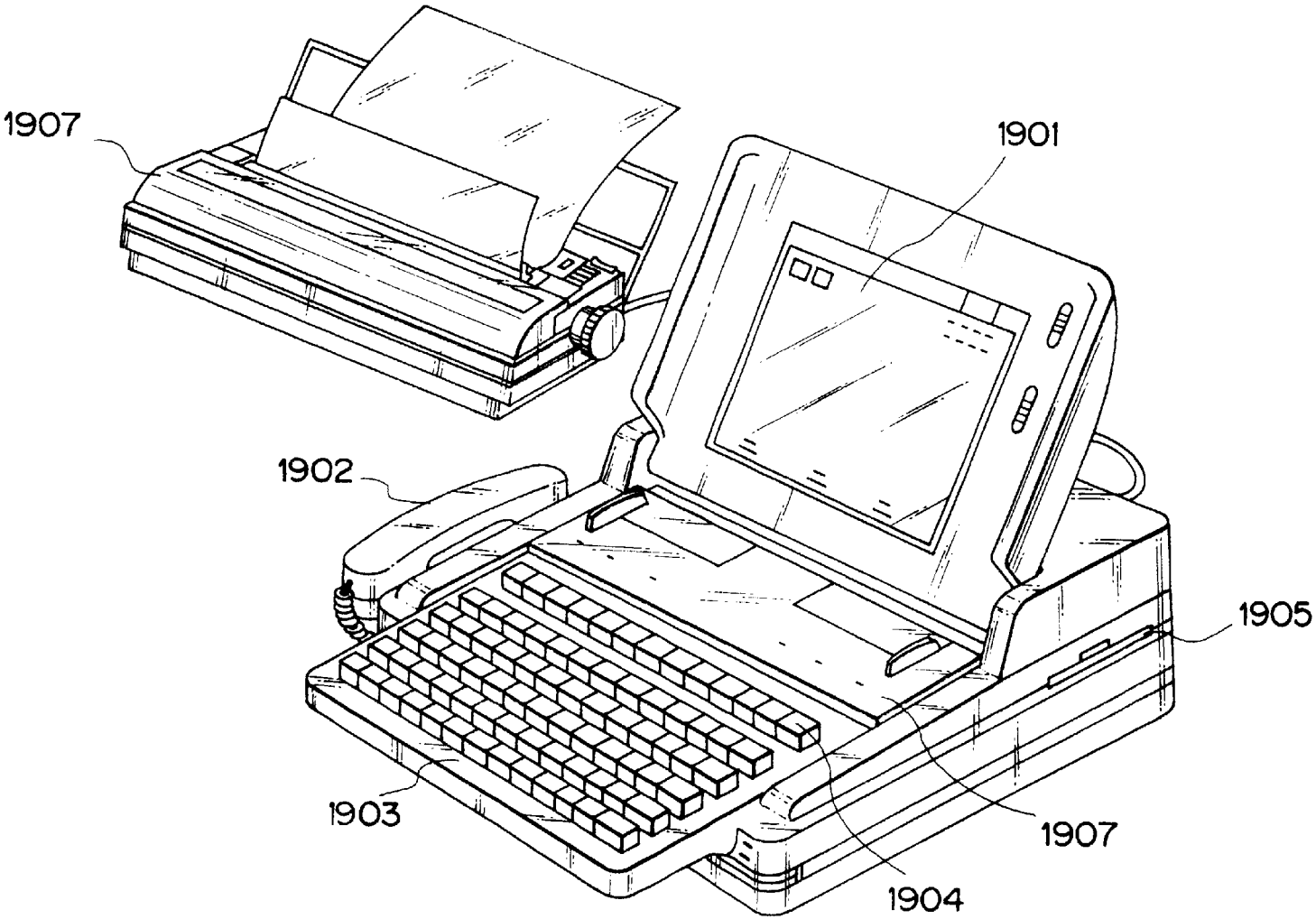
FIG. 9 is a perspective view showing the information processing apparatus in which the liquid crystal display device is used.

FIG. 9 is a perspective view of the information processing apparatus in FIG. 8.

Referring to FIG. 9, reference numeral 1901 denotes a flat panel display using the above liquid crystal display device, which displays various menus, graphic pattern information, document information, and the like. A coordinate input or item designation input operation can be performed on the flat panel display 1901 by pressing the surface of the touch panel 1803 with a finger of the user or the like. Reference numeral 1902 denotes a handset used when the apparatus is used as a telephone set. A keyboard 1903 is detachably connected to the main body via a cord and is used to perform various document functions and input various data. This keyboard 1903 has various function keys 1904. Reference numeral 1905 denotes an insertion port through which a floppy disk is inserted into the external memory unit 1812.

Reference numeral 1906 denotes an original table on which an original to be read by the image reader unit 1807 is placed. The read original is discharged from the rear portion of the apparatus. In a facsimile receiving operation, received data is printed out by an ink-jet printer 1907.

When the above information processing apparatus is to serve as a personal computer or a wordprocessor, various kinds of information input through the keyboard unit 1811 are processed by the control unit 1801 in accordance with a predetermined program, and the resultant information is output, as an image, to the printer unit 1806.

When the information processing apparatus is to serve as the receiver of the facsimile apparatus, facsimile information input through the transmission/reception unit 1808 via a communication line is subjected to reception processing in the control unit 1801 in accordance with a predetermined program, and the resultant information is output, as a received image, to the printer unit 1806.

When the information processing apparatus is to serve as the copying machine, an original is read by the image reader unit 1807, and the read original data is output, as an image to be copied, to the printer unit 1806 via the control unit 1801. Note that when the information processing apparatus is to serve as the receiver of the facsimile apparatus, original data read by the image reader unit 1807 is subjected to transmission processing in the control unit 1801 in accordance with a predetermined program, and the resultant data is transmitted to a communication line via the transmission/reception unit 1808.

Figure 10:
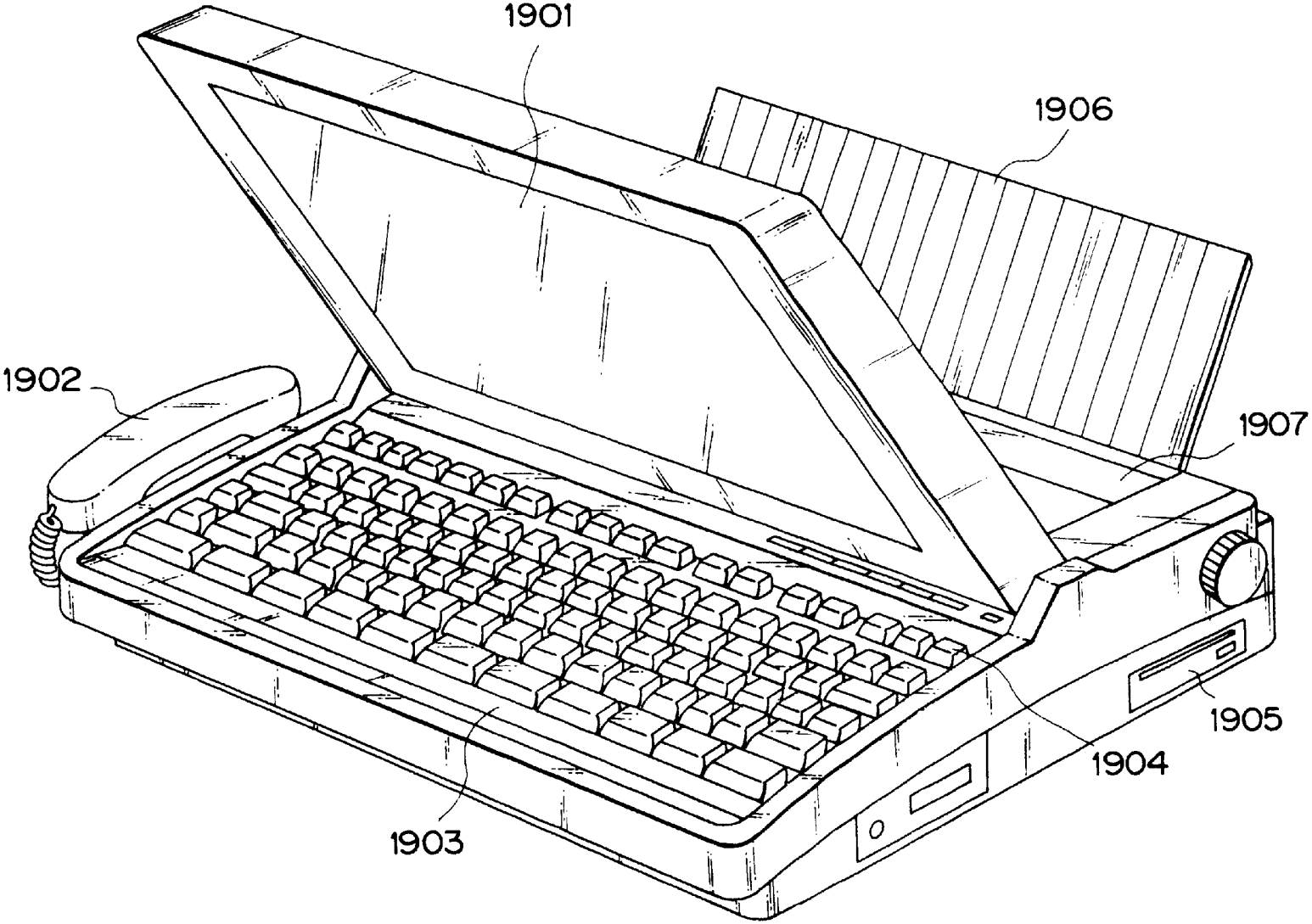
FIG. 10 is a perspective view showing the information processing apparatus in which the liquid crystal display device is used.

Note that the above information processing apparatus may be designed as an integrated apparatus incorporating an ink-jet printer in the main body, as shown in FIG. 10. In this case, the portability of the apparatus can be improved. The same reference numerals in FIG. 10 denote parts having the same functions as those in FIG. 9.

Embodiments of the color filter manufacturing method according the present invention will be described below.

First Embodiment

Figure 11:
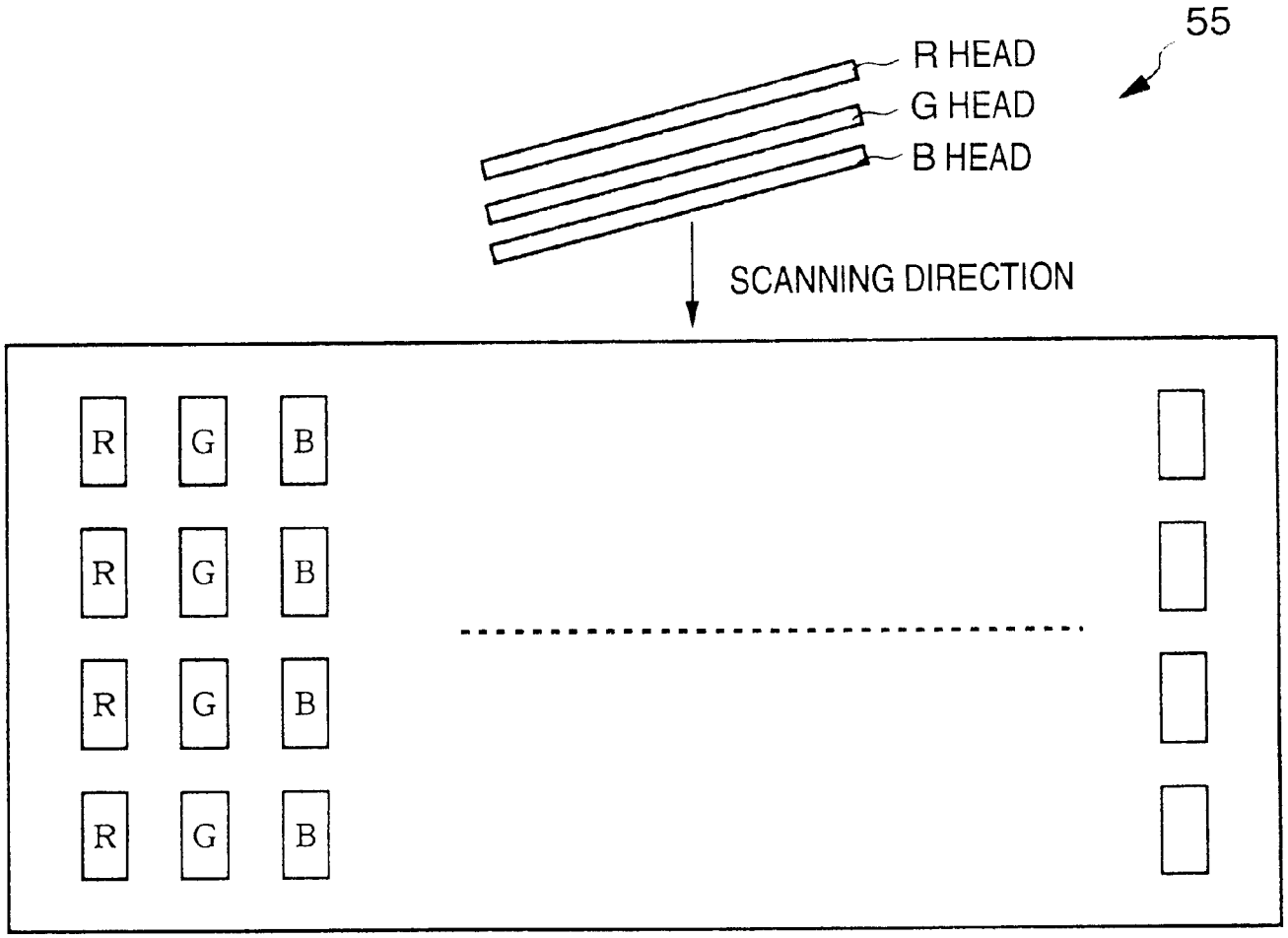
FIG. 11 is a view showing part of the color filter.

As shown in FIGS. 4A to 4F, a glass substrate, on which an ink receptible layer (resin layer 3) was formed, was colored with three, R, G, B color inks by a plurality of nozzles of an ink-jet head, as shown in FIG. 11, thereby forming pixels.

Coloring is performed by the following method to keep the amount of ink landed onto each pixel constant in order to avoid color irregularity of the color filter caused by a difference in ink amount between pixels.

(1) The ink discharging amount of each nozzle is measured in advance.

(2) To keep the ink amount to each pixel constant, the discharging amount of the nozzle is reflected on determining the number of dots landed onto the pixel. More specifically, when the nozzle has a large discharging amount, the number of dots in one pixel is decreased; when the nozzle has a small discharging amount, the number of dots in one pixel is increased.

The discharging amount of each nozzle varies with the lapse of time. For example, an increase in discharging amount of a given nozzle by 5% increases the amount of ink landed onto a pixel colored by the nozzle by 5%. As a result, the pixel is observed as having dark color irregularity. Therefore, to avoid color irregularity upon unpredictable variations in discharging amount and a decrease in yield, one pixel is effectively colored a plurality of times by a plurality of nozzles. The number of coloring operations and the number of types of nozzles used in forming one pixel are directly related to the yield. Increases in these numbers contradict a decrease in coloring tact time. Considering the yield and the tact time, a proper number of coloring operations is 1 to 10. In the first embodiment, the coloring operation is performed three times.

Figure 12:
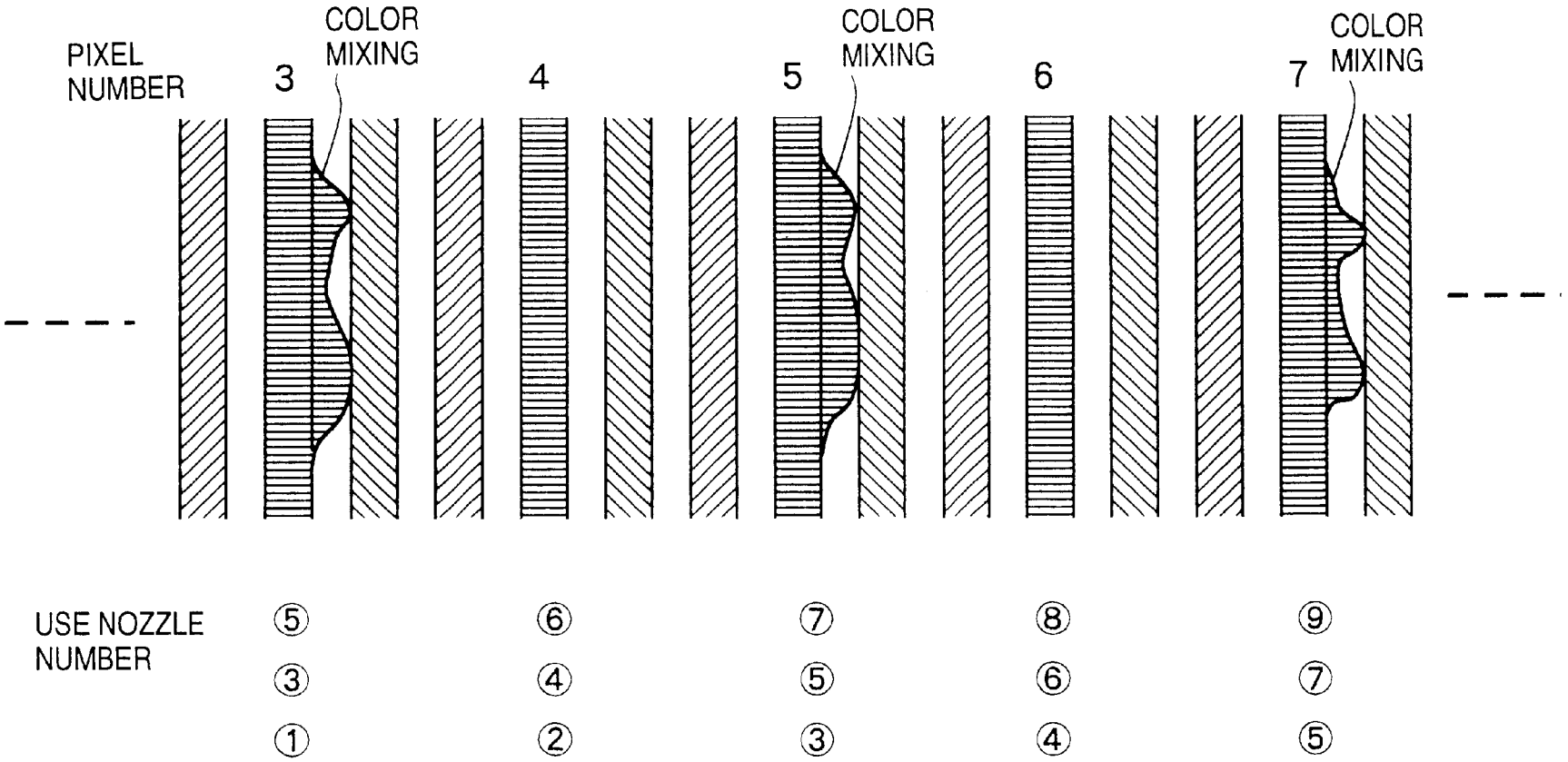
FIG. 12 is a view showing the state wherein color mixing occurs.

FIG. 12 schematically shows part of a color filter formed by the above method. The third, fifth, and seventh pixels suffer color mixing defects. A common nozzle used to form these pixels is the fifth nozzle, so that the color mixing defects are inferred to be generated by a discharge error of the fifth nozzle.

Figure 13:
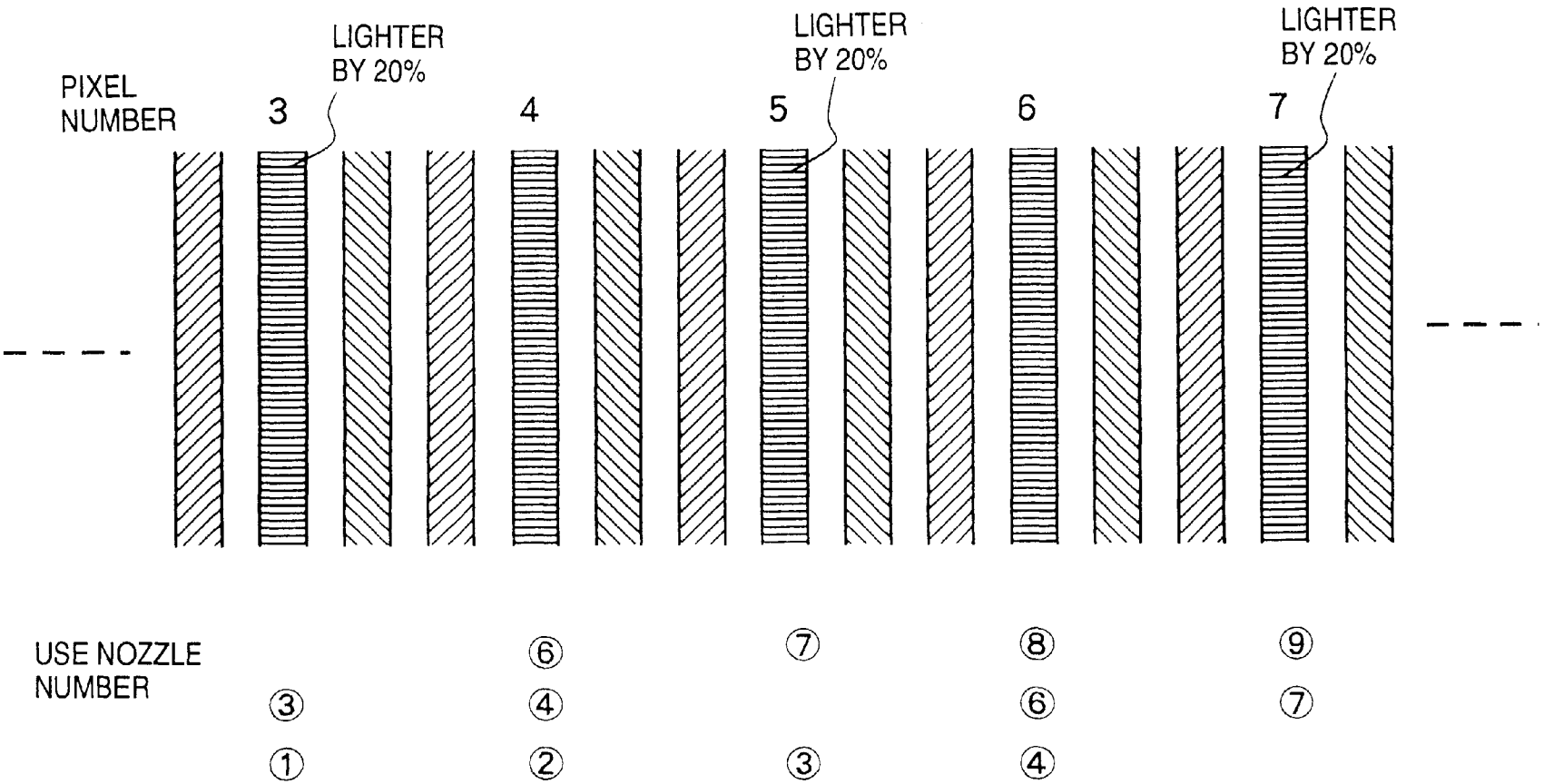
FIG. 13 is a view showing the state wherein coloring is performed without using a defective discharging nozzle.

It was determined to color a color filter substrate without discharging any ink from the fifth nozzle (FIG. 13). In this case, however, since no ink is landed from the fifth nozzle onto the third, fifth, and seventh pixels, the amount of ink landed onto these pixels is small. The lack of the amount of ink landed from the fifth nozzle was therefore compensated for by the third and seventh nozzles.

From the measurement results of the discharging amount of each nozzle, the ink amounts of the third, fifth, and seventh pixels were smaller by 20% than the target ink amount because no ink was landed from the fifth nozzle. The landing amounts from the third and seventh nozzles were respectively increased by 25% each to land the target ink amount onto the third, fifth, and seventh pixels.

Consequently, a high-quality color filter free from any pixel defect was manufactured with a high yield.

In the first embodiment, the lack of the ink amount in the pixel due to the absence of discharging operation of a defective nozzle is compensated for by increasing the number of inks discharged from other nozzles. However, the present invention is not limited to this, and the ink discharging amount per operation may be increased.

Second Embodiment

As shown in FIG. 11, resin-containing inks in three colors (R, G, and B) were discharged from a plurality of nozzles of an ink-jet head onto a transparent glass substrate on which a resin film was patterned as a light-shielding film, thereby forming pixels. The surface of the light-shielding film has ink repellency so as to avoid ink mixing between pixels. After the pixels were formed, the substrate was heated to harden the inks, forming a color filter.

Figure 14:
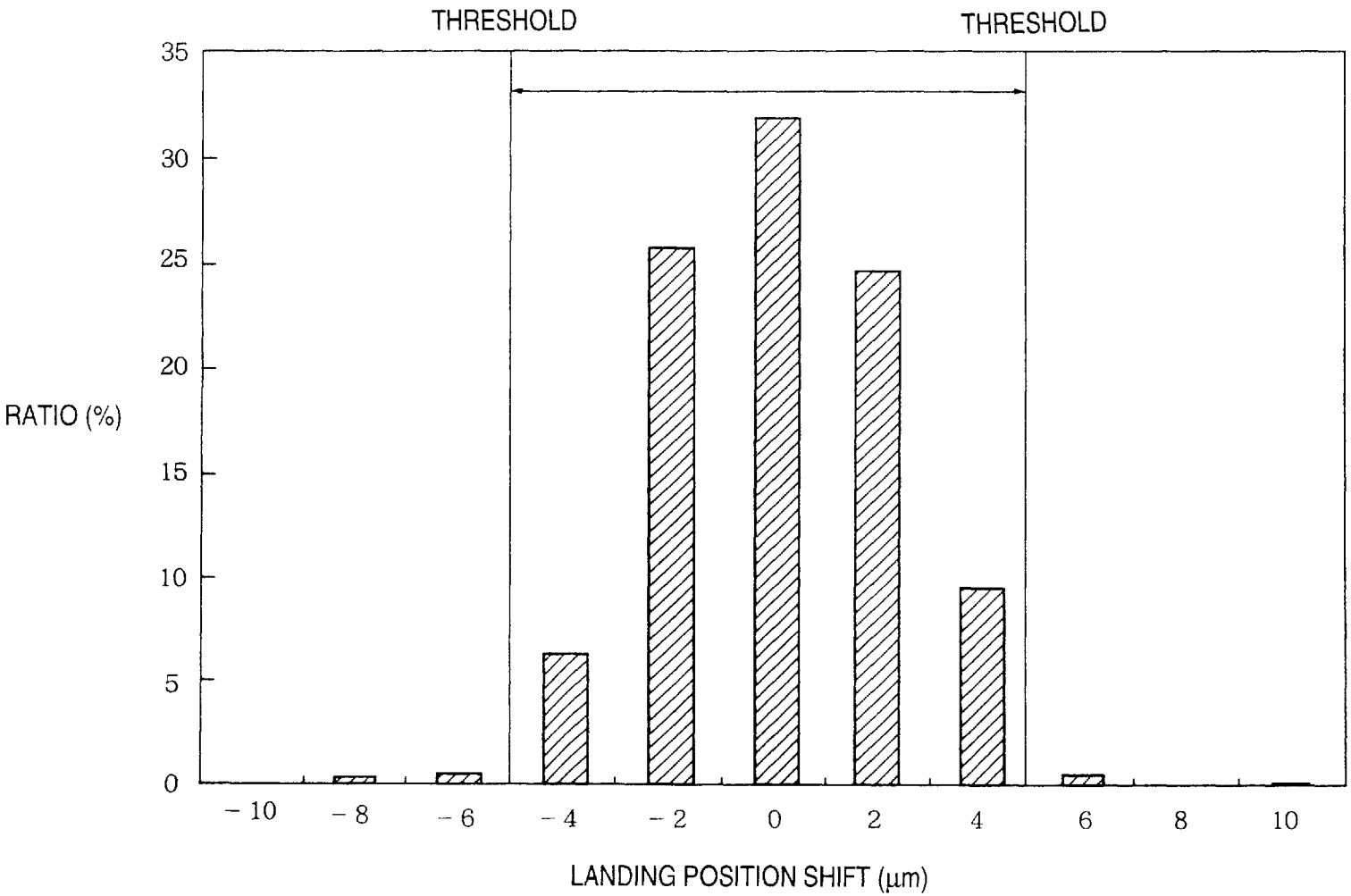
FIG. 14 is a graph showing the distribution of a landing position shift by the ink-jet head.

FIG. 14 shows the measurement results of shifts, from design values, of landing positions by all nozzles used upon coloring the pixels.

In coloring a color filter, a large landing error (landing position shift) often generates a color mixing defect, resulting in a low yield.

For this reason, it is determined not to use a nozzle causing a large landing position shift in discharging. In the second embodiment, the threshold of the landing position shift not to cause excessive brightness or color mixing was determined to be 5 $\mu$m, including the safety factor, in consideration of the cell size of a body to be colored. This value is desirably determined by a simulation or experiment in consideration of the pixel width, the pixel layout, the type of ink, the ink landing amount, the yield, and the like.

Figure 15:
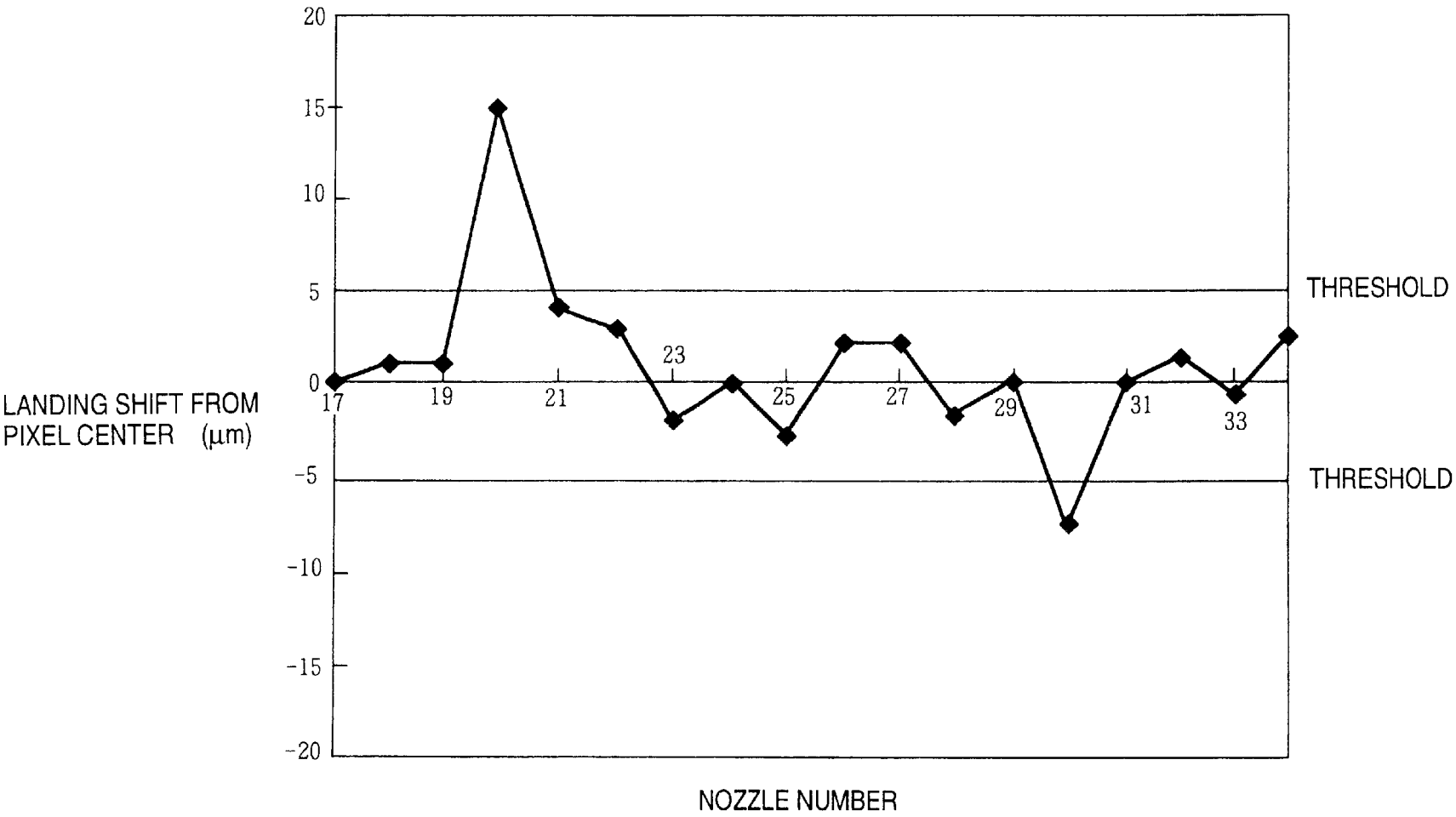
FIG. 15 is a graph showing some of measurement data of the landing position shift by the ink-jet head.

FIG. 15 shows some of the measurement results of landing position shifts by the head nozzles. From the data, landing position shifts by the 20th and 30th nozzles exceed 5 $\mu$m. Therefore, no ink was discharged from the 20th and 30th nozzles.

Coloring is performed by the following method to keep the amount of ink landed onto each pixel constant in order to avoid color irregularity of the color filter caused by a difference in ink amount between pixels.

(1) The ink discharging amount of each nozzle is measured in advance.

(2) To keep the ink amount to each pixel constant, the discharging amount of the nozzle is reflected on determining the number of dots landed onto the pixel. More specifically, when the nozzle has a large discharging amount, the number of dots in one pixel is decreased; when the nozzle has a small discharging amount, the number of dots in one pixel is increased.

Since no ink was discharged from the 20th and 30th nozzles, uncolored 20th and 30th pixels were colored using other nozzles.

As a result, a high-quality color filter free from any pixel defect was manufactured with a high yield.

Third Embodiment

As shown in FIGS. 4A to 4F, a glass substrate, on which an ink receptible layer (resin layer 3) was formed, was colored with three color inks (R, G, B) by a plurality of nozzles of an ink-jet head, as shown in FIG. 11, thereby forming pixels. As a result of measuring the discharging amount of a nozzle used in coloring the pixels, a given nozzle was different in discharging amount by 50% from the average discharging amount of all nozzles. Another nozzle with satellite discharging was also present.

Large shifts in the ink discharging amount and the dot diameter cause a color mixing defect and an excessively bright defect. As for a nozzle having an excessively large or small ink discharging amount or an excessively large or small dot diameter, the discharge state of the nozzle is often different from a designed state. Repeating unstable discharging decreases the yield.

The presence of satellite discharging also causes a color mixing defect upon ink landing on another pixel, thereby decreasing the yield.

For this reason, it is determined not to use a nozzle having an excessively large or small ink discharging amount or an excessively large or small dot diameter in discharging. In the third embodiment, the threshold of the ink discharging amount shift from the average was determined to be 50%, including the safety factor. This value is desirably determined by a simulation or experiment in consideration of the pixel width, the pixel layout, the type of ink, the ink landing amount, the yield, and the like. A nozzle with satellite discharging was not used in discharging, either.

Coloring is performed by the following method to keep the amount of ink landed onto each pixel constant in order to avoid color irregularity of the color filter caused by a difference in ink amount between pixels.

(1) The ink discharging amount of each nozzle is measured in advance.

(2) To keep the ink amount to each pixel constant, the discharging amount of the nozzle is reflected on determining the number of dots landed onto the pixel. More specifically, when the nozzle has a large discharging amount, the number of dots in one pixel is decreased; when the nozzle has a small discharging amount, the number of dots in one pixel is increased.

Since no ink was discharged from some nozzles, uncolored pixels were colored using other nozzles.

As a result, a high-quality color filter free from any pixel defect was manufactured with a high yield.

Fourth Embodiment

As shown in FIGS. 4A to 4F, a glass substrate, on which an ink receptible layer (resin layer 3) was formed, was colored with three color inks (R, G, B) by a plurality of nozzles of an ink-jet head, as shown in FIG. 11, thereby forming pixels. Coloring is performed by the following method to keep the amount of ink landed onto each pixel constant in order to avoid color irregularity of the color filter caused by a difference in ink amount between pixels.

(1) The ink discharging amount of each nozzle is measured in advance.

(2) To keep the ink amount to each pixel constant, the discharging amount of the nozzle is reflected on determining the number of dots landed onto the pixel. More specifically, when the nozzle has a large discharging amount, the number of dots in one pixel is decreased; when the nozzle has a small discharging amount, the number of dots in one pixel is increased.

Figure 16:
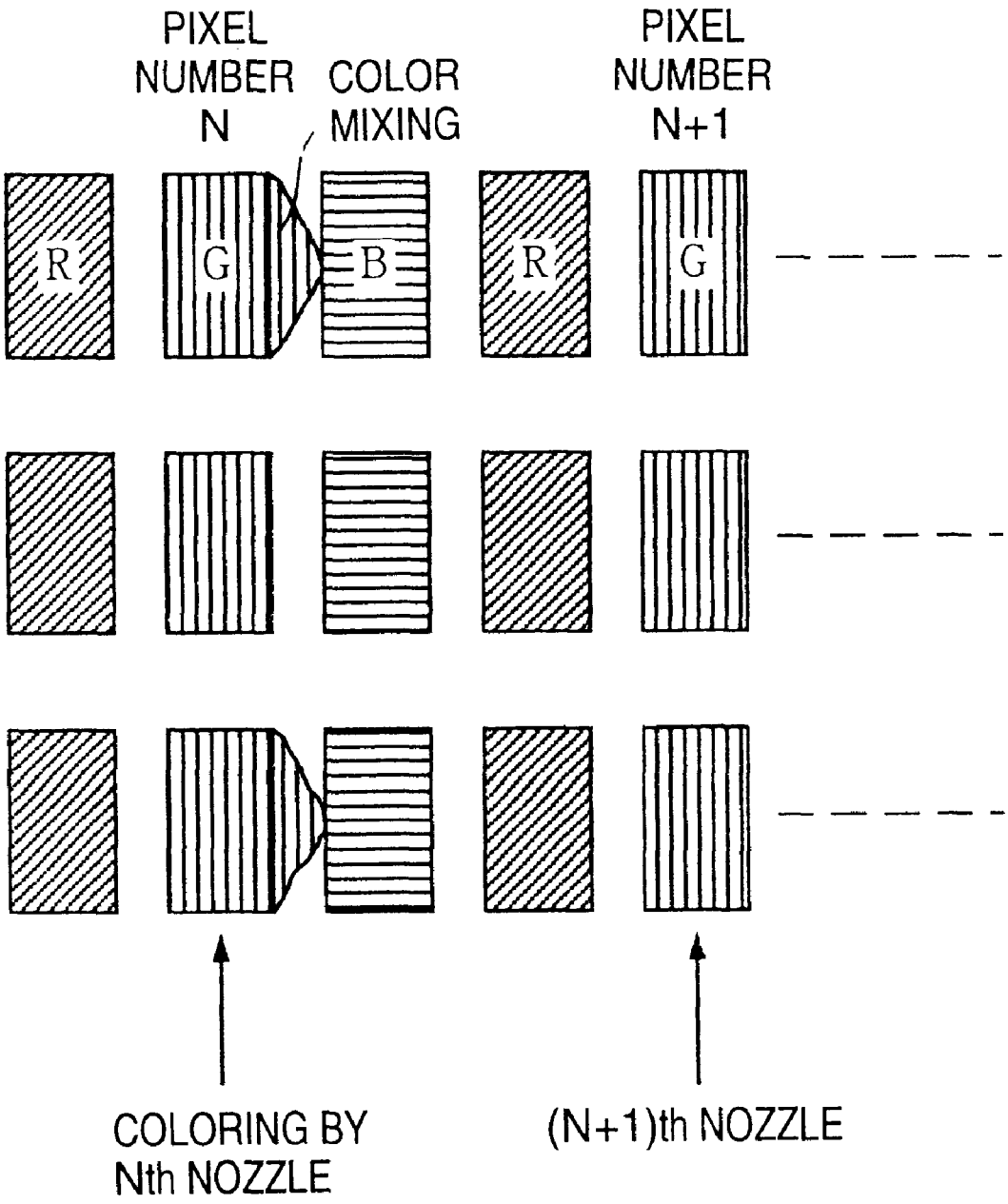
FIG. 16 is a view showing the state wherein color mixing occurs in the Nth pixel.

After the pixels were colored in this manner, the formed color filter was inspected to find color mixing defects in some pixels (pixel number N), as shown in FIG. 16. By detecting a defective pixel number, the nozzle used to color the pixel can be known. In FIG. 16, the colors of pixels colored by every Nth nozzle (every third nozzle) were mixed.

For this reason, the pixels of the color filter were colored without using the Nth nozzle in discharging.

Figure 17:
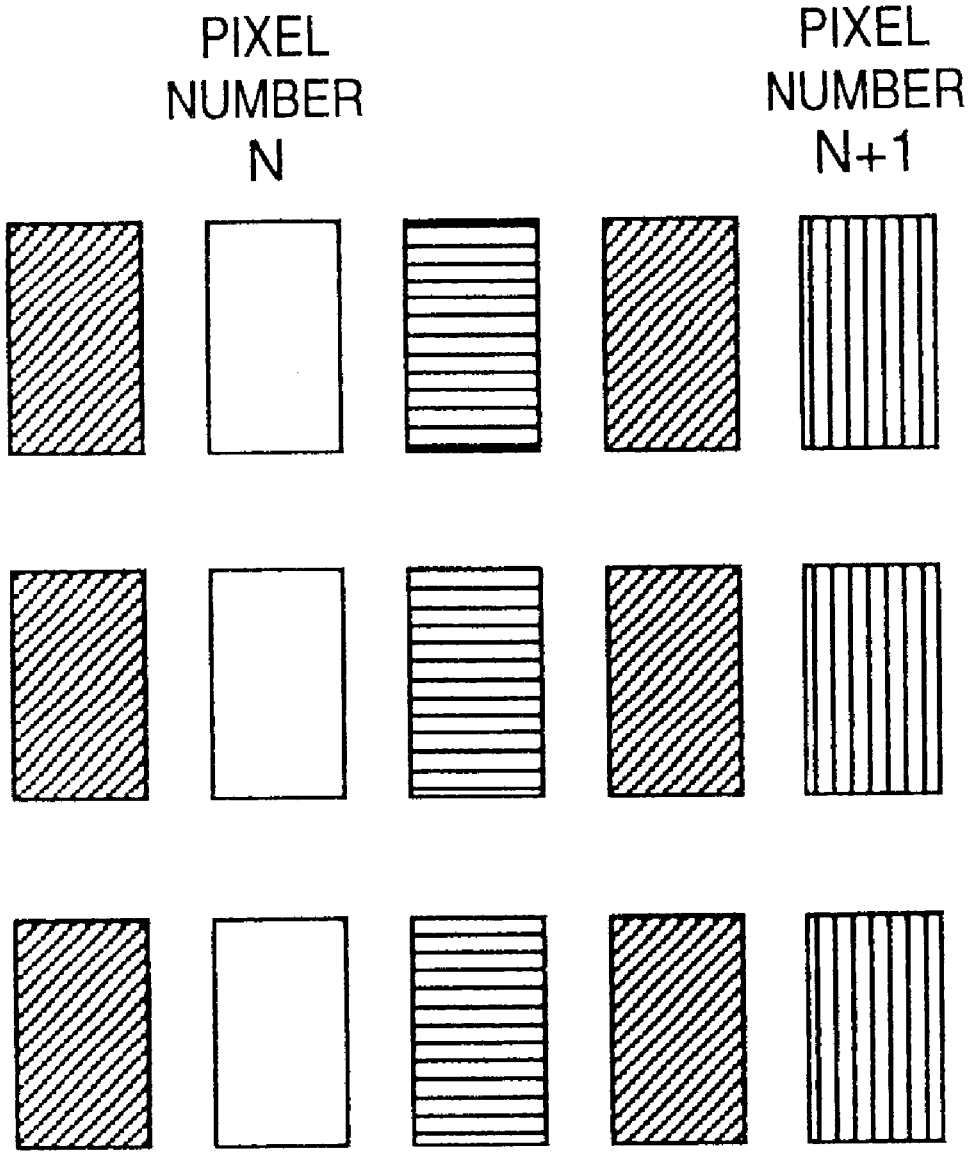
FIG. 17 is a view showing the state wherein the Nth pixel is not colored.
Figure 18:
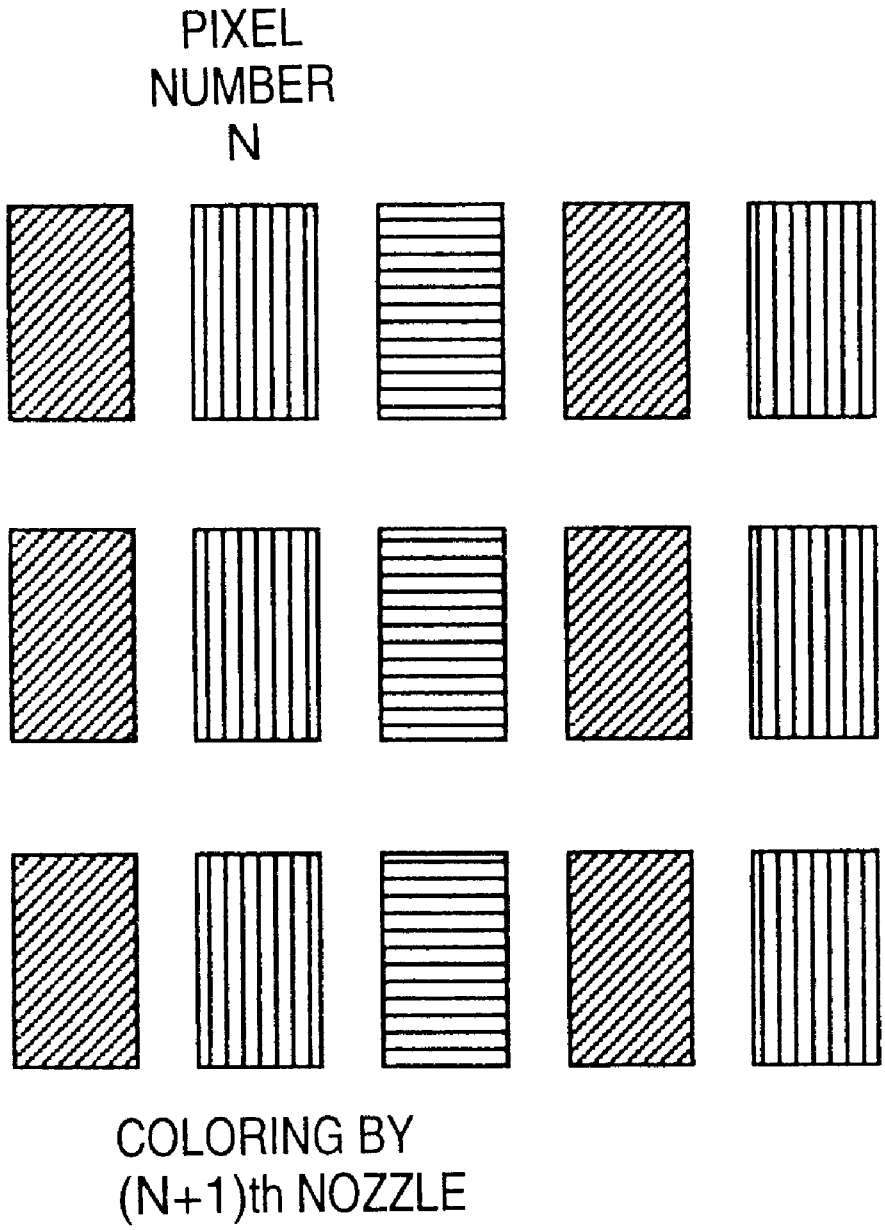
FIG. 18 is a view showing the state wherein the Nth pixel is colored by other nozzles.

Since no ink was discharged from every Nth nozzle, uncolored Nth pixels (FIG. 17) were colored using, of a plurality of nozzles, the (N+1)th nozzles (FIG. 18).

As a result, a high-quality color filter free from any pixel defect was manufactured with a high yield.

Fifth Embodiment

Figure 19:
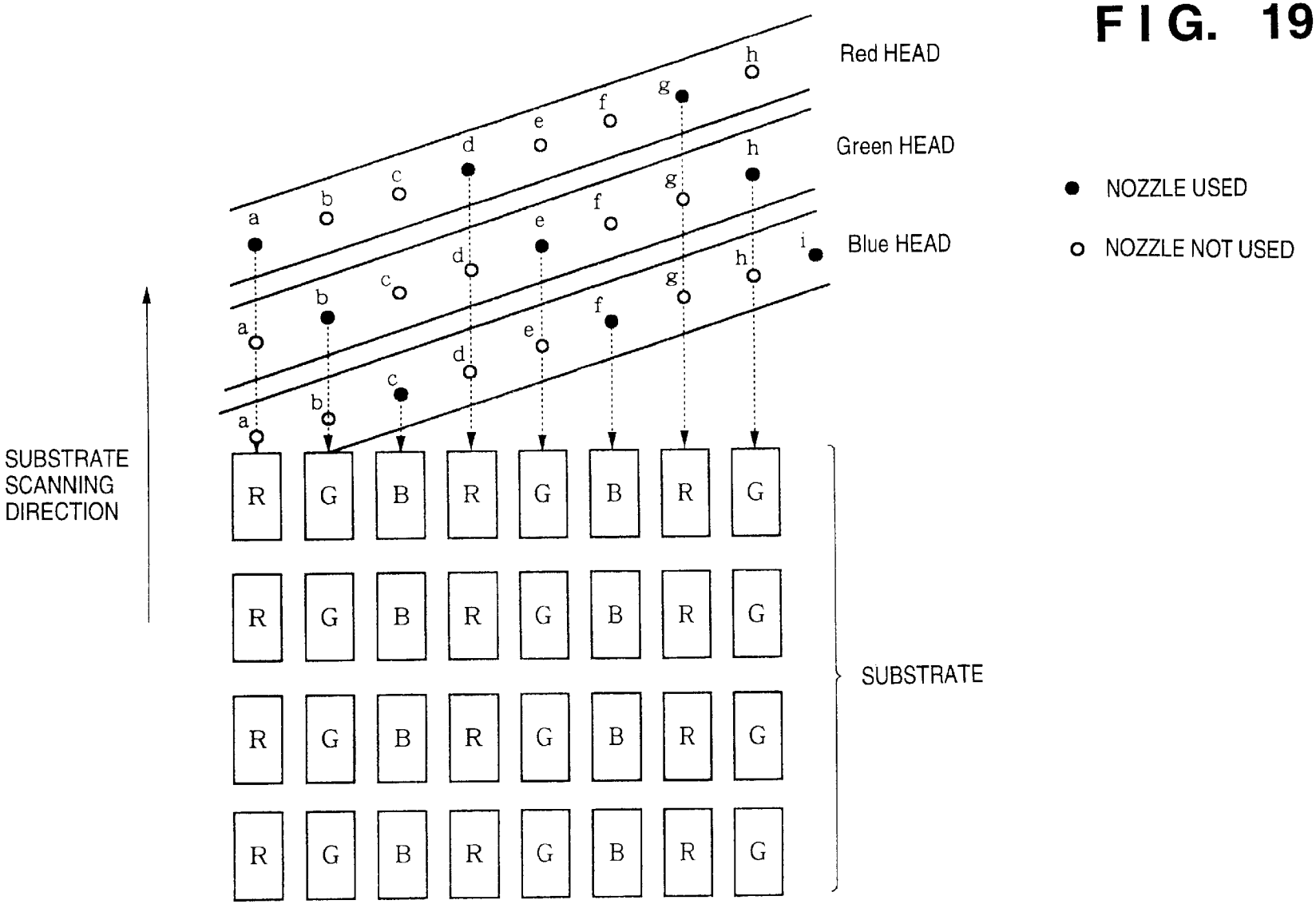
FIG. 19 is a view showing the state wherein coloring is performed while the ink-jet head is scanned.
Figure 20:
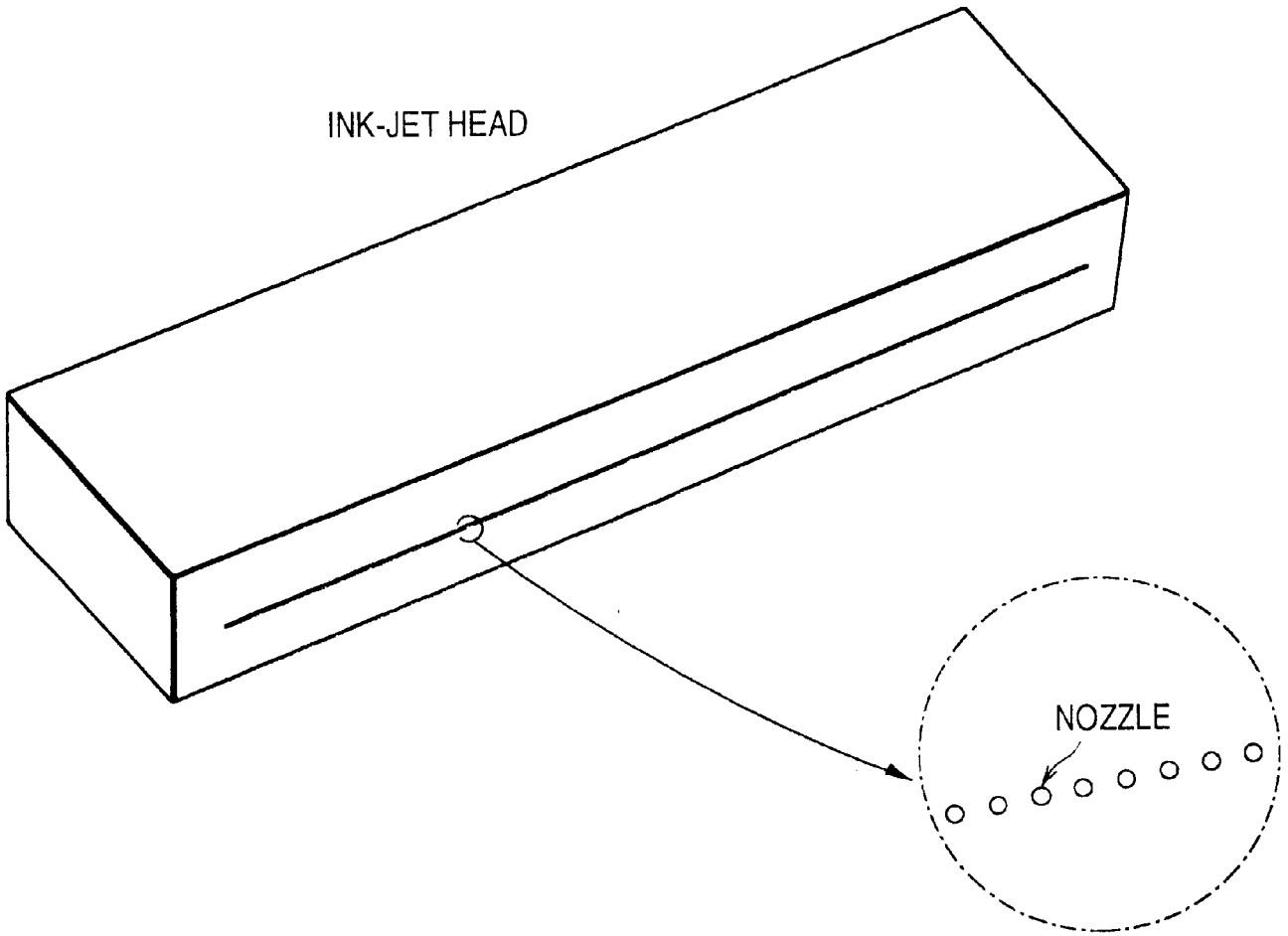
FIG. 20 is a schematic view of the ink-jet head.
Figure 21:
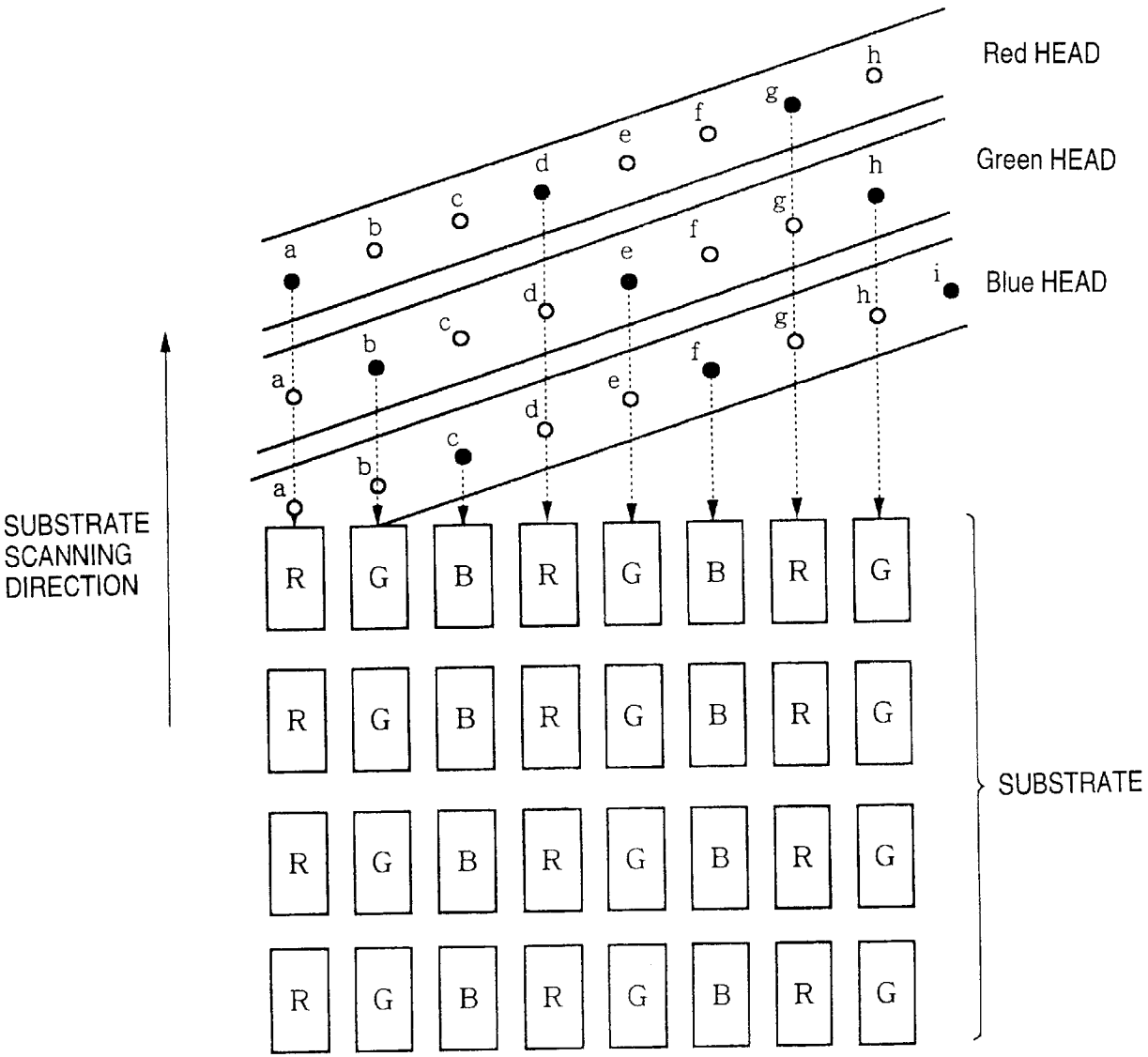
FIG. 21 is a view showing the state wherein coloring is performed while the ink-jet head is scanned.
Figure 22:
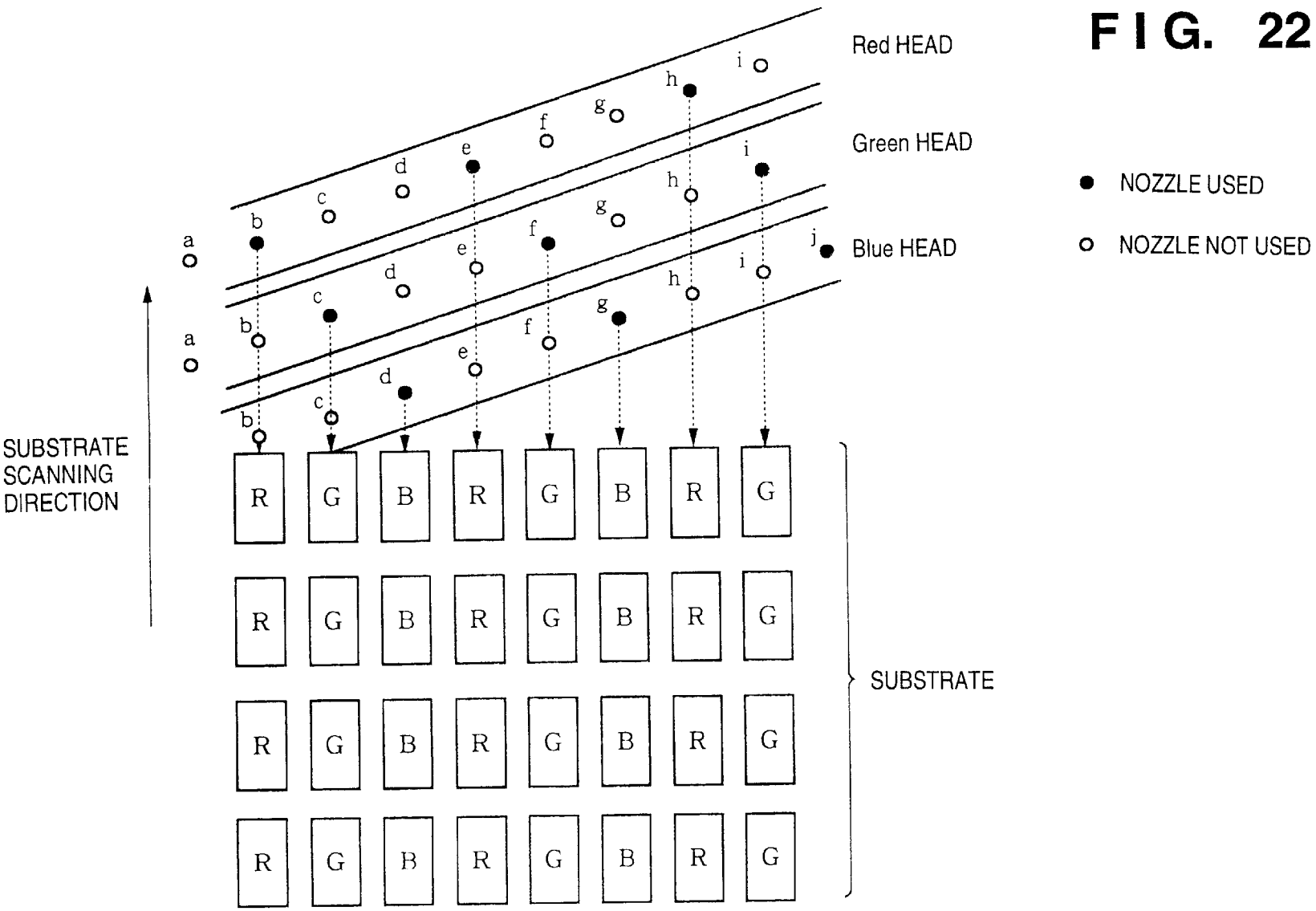
FIG. 22 is a view showing the state wherein coloring is performed while the ink-jet head is scanned.
Figure 23B:
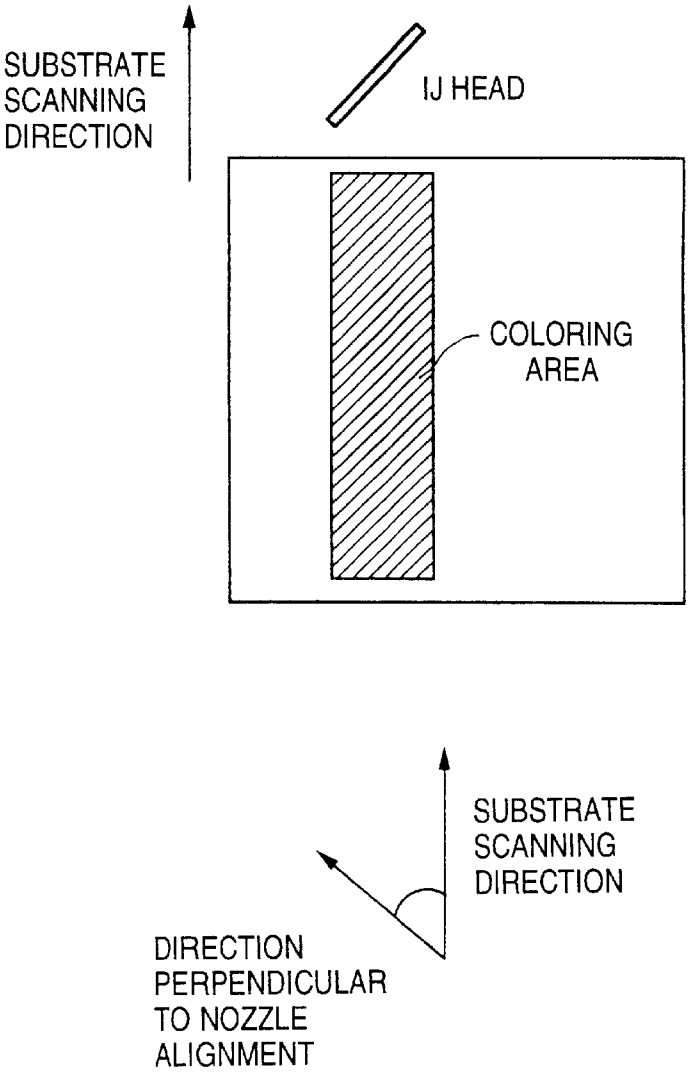
FIGS. 23A and 23B are views showing the positional relationship between a color filter substrate and the IJ head, and a colorable area.
Figure 23A:
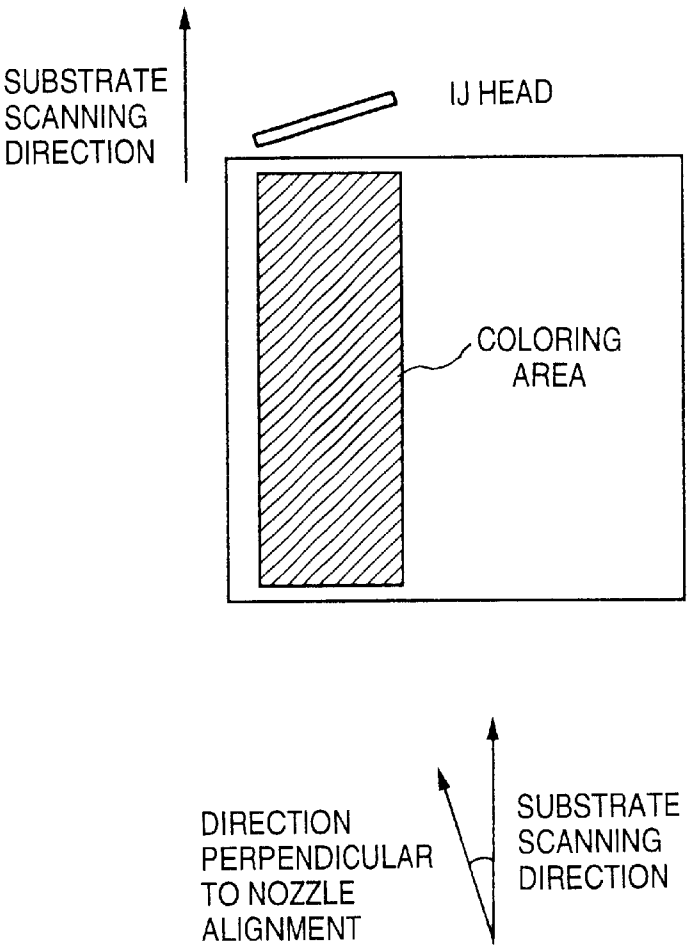

As shown in FIGS. 4A to 4F, a glass substrate, on which an ink receptible layer (resin layer 3) was formed, was colored with three color inks (R, G, B) by a plurality of nozzles of an ink-jet head, as shown in FIG. 11, thereby forming pixels. FIG. 19 schematically shows the relationship between the ink-jet head and pixels to be colored in this case.

In this case, a red ink-jet head colors pixels in red using nozzles a, d, and g (nozzle set 1). However, since nozzle set 1 includes a nozzle causing a large landing position shift, the pixels of the color filter were colored by the method described in the first embodiment. After this nozzle set was used until the normal operation service life, it was replaced with nozzles b, e, and h (nozzle set 2) to color the pixels of the color filter. Then, nozzles c, f, and i (nozzle set 3) were used in the same manner.

Since nozzle set 1 including a nozzle causing a large landing position shift can be used until the normal operation service life expires, all the nozzles of the ink-jet head can be used to maximize the use period of the head.

As described above, according to the embodiments, even if a discharge error occurs in some nozzles of the ink-jet head, the ink-jet head can be used until its service life expires to increase the use efficiency of the ink-jet head and the operation rate of machines by decreasing the frequency of the need to exchange the ink-jet head.

Various changes and modifications of the above embodiments can be made without departing from the spirit and scope of the invention.

In the above embodiments, a defective nozzle is determined after forming a color filter. Instead, a pixel defect can be detected in coloring the pixels of a color filter by an ink-jet method, and determination of nozzles for use and correction of the density can be performed in real time.

Recently, some panels comprise color filters on the TFT array side. The color filter defined in this specification is merely a body colored by a coloring material, and includes both color filters arranged on the TFT array side and the opposite side.

According to the above description, the present invention is applied to the print apparatus of the system, among various ink-jet recording systems, which has a means (e.g., an electrothermal converter or laser light) for generating heat energy as energy used to discharge an ink, and changes the state of an ink by using the heat energy. According to this system, a high-density, high-definition recording operation can be realized.

As for the typical structure and principle, it is preferable that the basic structure disclosed in, for example, U.S. Pat. Nos. 4,723,129 or 4,740,796 is employed. The above method can be adapted to both a so-called on-demand type apparatus and a continuous-type apparatus. In particular, a satisfactory effect can be obtained when the on-demand type apparatus is employed because of the structure arranged in such a manner that one or more drive signals, which rapidly raise the temperature of an electrothermal converter disposed to face a sheet or a fluid passage which holds the fluid (ink) to a level higher than levels at which film boiling takes place are applied to the electrothermal converter in accordance with recording information so as to generate heat energy in the electrothermal converter and to cause film boiling to take place at the heat effecting surface of the recording head so that bubbles can be formed in the fluid (ink) to correspond to the one or more drive signals. The enlargement/contraction of the bubble will cause the fluid (ink) to be discharged through a discharging opening so that one or more droplets are formed. If a pulse-shaped drive signal is employed, the bubble can be enlarged/contracted immediately and properly, causing a further preferred effect to be obtained because the fluid (ink) can be discharged while revealing excellent responsiveness.

It is preferable that a pulse drive signal disclosed in U.S. Pat. Nos. 4,463,359 or 4,345,262 is employed. If conditions disclosed in U.S. Pat. No. 4,313,124, which describes an invention relating to the temperature rising ratio at the heat effecting surface, are employed, a satisfactory recording result can be obtained.

As an alternative to the structure (linear fluid passage or perpendicular fluid passage) of the recording head disclosed in each of the above inventions and having an arrangement that discharge ports, fluid passages and electrothermal converters are combined, a structure having an arrangement that the heat effecting surface is disposed in a bent region as disclosed in U.S. Pat. Nos. 4,558,333 or 4,459,600 may be employed.

Furthermore, as a recording head of the full line type having a length corresponding to the maximum width of a recording medium which can be recorded by the recording apparatus, either the construction which satisfies its length by a combination of a plurality of recording heads as disclosed in the above specifications or the construction as a single full line type recording head which has integrally been formed can be used.

In addition, the invention is effective for a recording head of the freely exchangeable chip type which enables electrical connection to the recording apparatus main body or supply of ink from the main device by being mounted onto the apparatus main body, or for the case by use of a recording head of the cartridge type provided integrally on the recording head itself.

It is preferred to additionally employ the recording head restoring means and the auxiliary means provided as a component of the present invention because the effect of the present invention can be further stabilized. Specifically, it is preferable to employ a recording head capping means, a cleaning means, a pressurizing or suction means, an electrothermal converter, another heating element, a sub-heating means or combination thereof and a sub-emitting mode means for causing an emitting to be performed independently from the recording emitting in order to stably perform the recording operation.

Although a fluid ink is employed in the above embodiments of the present invention, an ink which is solidified at room temperature or lower, or an ink which is softened or liquified at room temperature may be used. That is, any ink which is liquified when a recording signal is supplied may be used.

Furthermore, an ink which is solidified when it is caused to stand, and liquified when heat energy is supplied in accordance with a recording signal can be adapted to the present invention to positively prevent a temperature rise caused by heat energy by utilizing the temperature rise as energy of state transition from the solid state to the liquid state or to prevent ink evaporation. In any case, an ink which is liquified when heat energy is supplied in accordance with a recording signal so as to be discharged in the form of fluid ink, or an ink which is liquified only after heat energy is supplied, e.g., an ink which starts to solidify when it reaches a recording medium, can be adapted to the present invention.

As has been described above, according to the present invention, since no defective discharging nozzle is used to color a color filter, a pixel defect caused by the defective discharging nozzle can be avoided. A high-quality color filter free from any pixel defect can be manufactured with a high yield.

Since a pixel defect caused by the defective discharging nozzle can be avoided, the use period of the ink-jet head used to color a color filter can be maximized to decrease the frequency to exchange the ink-jet head and to prevent the low operation rate of machines caused by the working time for exchanging the ink-jet head. Consequently, the cost of the ink-jet head is reduced, realizing a low-cost color filter.

The present invention is not limited to the above embodiments and various changes and modifications can be made within the spirit and scope of the present invention. Therefore, to apprise the public of the scope of the present invention the following claims are made.

What is claimed is:

1. A color filter manufacturing method comprising the steps of:

discharging an ink from a plurality of ink discharging nozzles onto a plurality of pixels and forming colored portions while an ink-jet head having the plurality of ink discharging nozzles is scanned relatively to a body to be colored on which the pixels, onto which the ink is to be landed, are aligned in advance, wherein each one pixel of the plurality of the pixels is colored by a plurality of ink droplets discharged from two or more assigned nozzles of the plurality of ink discharging nozzles;

determining whether any of the plurality of ink discharging nozzles for discharging the ink onto the pixels are defective;

stopping discharging of the ink from nozzles determined to be defective in said determining step; and compensating for a lack of a sufficient ink amount in a pixel to be colored by the defective nozzles of the plurality of pixels, due to the stopping of discharging from the defective nozzles, by discharging the ink onto the pixel to be colored by the defective nozzles from nozzles other than the defective nozzles, wherein when a defective nozzle is among the two or more assigned nozzles for a particular pixel, the lack of sufficient ink amount is compensated by discharging the ink from one or more other nozzles of the assigned nozzles for the particular pixel.

2. The method according to claim 1, wherein the plurality of discharging nozzles for discharging the ink onto the pixels are nozzles arranged on the same head, the discharging nozzles discharging the ink onto the pixels in a plurality of scanning operations with the ink discharging nozzles being shifted in every scanning operation.

3. The method according to claim 2, wherein the ink is discharged using, of the plurality of ink discharging nozzles, ink discharging nozzles operated in a predetermined cycle, and ink discharging nozzles for compensating for the defective nozzles are selected in accordance with the predetermined cycle.

4. The method according to claim 1, wherein the lack of sufficient ink amount in the pixel to be colored by the defective nozzles is compensated for by increasing the number of ink droplets discharged onto the pixel to be colored by the defective nozzles from the other ink discharging nozzles.

5. The method according to claim 1, wherein the lack of sufficient ink amount in the pixel to be colored by the defective nozzles is compensated for by increasing a discharging amount discharged onto the pixel to be colored by the defective nozzles per discharging operation by the other ink discharging nozzles.

6. The method according to claim 1, wherein the ink-jet head discharges the ink using heat energy, and comprises a heat energy generator for generating the heat energy to be applied to the ink.

7. The method according to claim 1, wherein the ink-jet head comprises a piezoelectric element, and discharges the ink from the nozzles upon vibration of the piezoelectric element.

8. The method according to claim 1, wherein said determining step comprises a step of detecting the defective discharging nozzles.

9. The method according to claim 8, wherein said detecting step comprises experimentally coloring the body to be colored and detecting an ink discharging nozzle causing a coloring defect in the experimental coloring.

10. The method according to claim 8, wherein said detecting step comprises measuring landing position precision of the ink discharged from the plurality of ink discharging nozzles, and determining a nozzle causing a landing position shift from a predetermined threshold to be among the defective discharging nozzles.

11. The method according to claim 8, wherein said detecting step comprises measuring an ink discharging amount per operation from the plurality of ink discharging nozzles, and detecting an ink discharging nozzle having a poor discharging amount precision.

12. The method according to claim 8, wherein said detecting step comprises estimating the defective discharging nozzles from a combination of the plurality of ink discharging nozzles.

13. A color filter manufactured by the steps of:

discharging an ink from a plurality of ink discharging nozzles onto a plurality of pixels and forming colored portions while an ink-jet head having the plurality of ink discharging nozzles is scanned relatively to a body to be colored on which the pixels, onto which the ink is to be landed, are aligned in advance, wherein each one pixel of the plurality of the pixels is colored by a plurality of ink droplets discharged from two or more assigned nozzles of the plurality of ink discharging nozzles;

determining whether any of the plurality of ink discharging nozzles for discharging the ink onto the pixels are defective;

stopping discharging of the ink from the nozzles determined to be defective in said determining step; and compensating for a lack of a sufficient ink amount in a pixel to be colored by the defective nozzles of the plurality of pixels, due to the stopping of discharging from the defective nozzles, by discharging the ink onto the pixel to be colored by the defective nozzles from nozzles other than the defective nozzles, wherein when a defective nozzle is among the two or more assigned nozzles for a particular pixel, the lack of sufficient ink amount is compensated by discharging the ink from one or more other nozzles of the assigned nozzles for the particular pixel.

14. A display device comprising:

a color filter manufactured by the steps of:

discharging an ink from a plurality of ink discharging nozzles onto a plurality of pixels and forming colored portions while an ink-jet head having the plurality of ink discharging nozzles is scanned relatively to a body to be colored on which the pixels, onto which the ink is to be landed, are aligned in advance, wherein each one pixel of the plurality of the pixels is colored by a plurality of ink droplets discharged from two or more assigned nozzles of the plurality of ink discharging nozzles, determining whether any of the plurality of ink discharging nozzles for discharging the ink onto the pixels are defective, stopping discharging of the ink from the nozzles determined to be defective in said determining step, and compensating for a lack of a sufficient ink amount in a pixel to be colored by the defective nozzles of the plurality of pixels, due to the stopping of discharging from the defective nozzles, by discharging the ink onto the pixel to be colored by the defective nozzles from nozzles other than the defective nozzles, wherein when a defective nozzle is among the two or more assigned nozzles for a particular pixel, the lack of sufficient ink amount is compensated by discharging the ink from one or more other nozzles of the assigned nozzles for the particular pixel; and light amount changing means for changing a light amount from said color filter.

15. An apparatus comprising:

a display device including:

a color filter manufactured by the steps of:

discharging an ink from a plurality of ink discharging nozzles onto a plurality of pixels and forming colored portions while an ink-jet head having the plurality of ink discharging nozzles is scanned relatively to a body to be colored on which the pixels, onto which the ink is to be landed, are aligned in advance, wherein each one pixel of the plurality of the pixels is colored by a plurality of ink droplets discharged from two or more assigned nozzles of the plurality of ink discharging nozzles, determining whether any of the plurality of ink discharging nozzles for discharging the ink onto the pixels are defective, stopping discharging of the ink from the nozzles determined to be defective in said determining step, and compensating for a lack of a sufficient ink amount in a pixel to be colored by the defective nozzles of the plurality of pixels due to the stopping of discharging from the defective nozzles, by discharging the ink onto the pixel to be colored by the defective nozzles from nozzles other than the defective nozzles, wherein when a defective nozzle is among the two or more assigned nozzles for a particular pixel, the lack of sufficient ink amount is compensated by discharging the ink from one or more other nozzles of the assigned nozzles for the particular pixel, and light amount changing means for changing a light amount from said color filter; and image signal supply means for supplying an image signal to said display device.

* * * * *